US006981790B2

(12) United States Patent
Suzuki

(10) Patent No.: US 6,981,790 B2
(45) Date of Patent: Jan. 3, 2006

(54) TWO-LIGHT HEADLAMP

(75) Inventor: Eiji Suzuki, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 147 days.

(21) Appl. No.: 10/215,197

(22) Filed: Aug. 9, 2002

(65) Prior Publication Data

US 2003/0048642 A1 Mar. 13, 2003

(30) Foreign Application Priority Data

| | | |
|---|---|---|
| Aug. 10, 2001 | (JP) | 2001-244666 |
| Sep. 14, 2001 | (JP) | 2001-280331 |
| Jun. 17, 2002 | (JP) | 2002-176013 |
| Jun. 17, 2002 | (JP) | 2002-176014 |

(51) Int. Cl.
*F21V 1/00* (2006.01)

(52) U.S. Cl. ..... 362/509; 362/531; 362/532; 362/512; 362/513; 362/538; 362/465; 362/468

(58) Field of Classification Search ..... 362/509, 362/466, 531, 465, 467, 468, 515, 512, 513, 362/538, 311, 539

See application file for complete search history.

(56) References Cited

U.S. PATENT DOCUMENTS

| | | | | |
|---|---|---|---|---|
| 5,673,990 | A | 10/1997 | Neumann et al. | |
| 5,899,559 | A | 5/1999 | Lachmayer et al. | |
| 6,286,985 | B1 * | 9/2001 | Ohshio et al. | 362/512 |
| 6,312,147 | B2 | 11/2001 | Eichler | |
| 6,425,683 | B1 * | 7/2002 | Kusagaya et al. | 362/512 |
| 6,607,295 | B2 * | 8/2003 | Hayakawa | 362/517 |

FOREIGN PATENT DOCUMENTS

EP 0 794 382 A2 9/1997

* cited by examiner

*Primary Examiner*—Sandra O'Shea
*Assistant Examiner*—Bertrand Zeade
(74) *Attorney, Agent, or Firm*—Foley & Lardner LLP

(57) ABSTRACT

A shade is moved to a high-beam position by a driving force of a solenoid and held in that position. The shade is switched to a low-beam position by a spring force of a plate spring and held in that position. The solenoid is the pull-type solenoid. The shade is thin and therefore light in weight. As a result, low-cost and light-weight headlamp is obtained. Moreover, switching of the beams can be performed accurately.

23 Claims, 23 Drawing Sheets

TWO-LIGHT HEADLAMP

BACKGROUND OF THE INVENTION

1) Field of the Invention

The present invention relates to a two-light headlamp in which a predetermined light distribution pattern for passing by and a predetermined light distribution pattern for driving can be obtained from one light source respectively by switching, and for example, relates to a projector-type two-light headlamp.

2) Description of the Related Art

As this type of headlamps, there can be mentioned, for example, one disclosed in European Patent Publication No. 0 794 382 A2,one disclosed in U.S. Pat. Publication No. 5,673,990,one disclosed in U.S. Pat. Publication No. 5,899,559 and one disclosed in U.S. Pat. Publication No. 6,312,147 B2.

The headlamp will be explained below. The headlamp comprises, one light source, a reflector which reflects light from the one light source, a condenser lens which irradiates the reflected light from the reflector forward, a shade which switches the irradiated light from the condenser lens to low beam and high beam, and a solenoid which switches the shade to a low-beam position and a high-beam position.

In the headlamp, the light source is lighted. The light from the light source is reflected by the reflector. The reflected light is irradiated forwards through the condenser lens. Here, the solenoid is driven to switching the shade to the low-beam position or a high-beam position. The irradiated light is then switched to the low beam or high beam. As a result, a predetermined light distribution pattern for passing by, by the low beam, and a predetermined light distribution pattern for driving, by the high beam, can be obtained by switching by the low beam and the high beam, respectively.

SUMMARY OF THE INVENTION

It is an object of this invention to provide a headlamp whose production cost is cheap, and which can accurately switch the low beam and the high beam.

In order to achieve the above object, this invention comprises a shade which is constituted of a thin plate structure, and switches the light from a light source to a low beam or a high beam, a plate spring which switches the shade to a low-beam position by a spring force and holds the shade in that position, and a solenoid which switches the shade to a high-beam position by a driving force when the electric supply is ON and holds the shade in that position.

As a result, this invention can reduce the weight of the shade, because the shade is constituted of a thin plate structure. Thereby, this invention can reduce the driving force of the solenoid and the spring force of the plate spring, which switch the position of the shade either to the low-beam position or to the high-beam position. Accordingly, in this invention, a cheap solenoid having a small driving force and a cheap spring member having a small spring force can be used, thereby enabling reduction of the production cost. In this invention, since the weight of the shade is light, the switching operation of the shade can be easily and accurately performed by the solenoid and the plate spring. As a result, with this invention, the low beam and the high beam can be accurately switched.

In this invention, the shade is switched to a high-beam position by a driving force of the solenoid and held in the position, and on the other hand, the shade is switched to a low-beam position by a spring force of the plate spring and held in the position. Therefore, a pull-type solenoid which is cheap and efficient can be used as the solenoid. As a result, with this invention, the production cost is cheap, and the low beam and high beam can be accurately switched.

These and other objects, features and advantages of the present invention are specifically set forth in or will become apparent from the following detailed descriptions of the invention when read in conjunction with the accompanying drawings.

DETAILED DESCRIPTIONS

Figure 1:
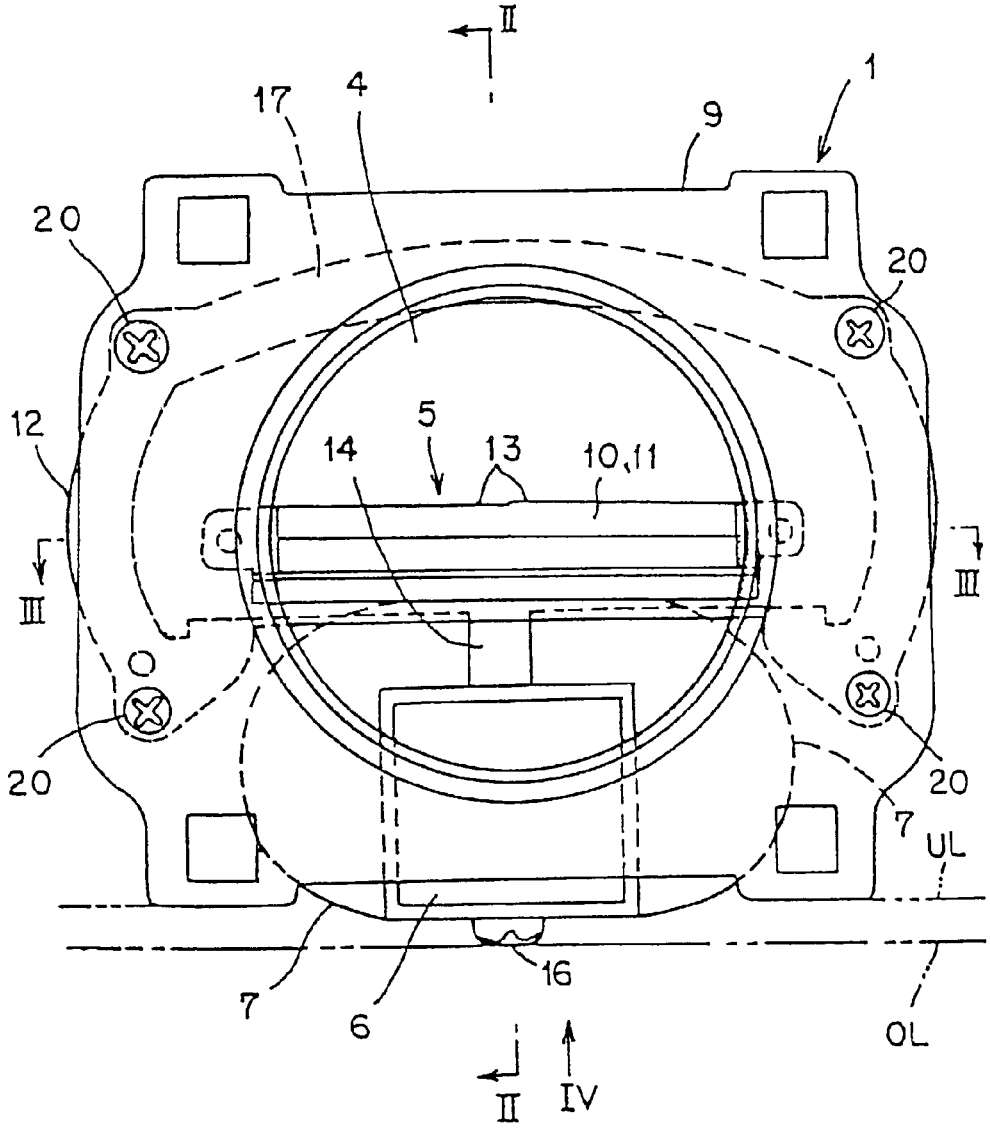
FIG. 1 is an elevational view which shows a first embodiment of a headlamp of this invention.

Embodiments of the headlamp according to this invention will be explained below with reference to the accompanying drawings. However, this invention is by no means limited by the embodiments.

FIGS. 1 to 20 explain a first embodiment of the headlamp according to this invention. Although the shown headlamp is a projector-type two-light headlamp, the headlamp may be any of the two-light headlamps.

In FIG. 1 to FIG. 4, reference symbol 1 denotes a projector-type headlamp. This headlamp 1 comprises a discharge lamp 2 as a light source, a reflector 3, a condenser lens 4, a shade 5, and a solenoid 6 and a plate spring 7 as a switching unit.

The discharge lamp 2 is, for example, a high-pressure metal vapor discharge lamp such as a so-called metal halide lamp, or a high intensity discharge lamp (HID). The discharge lamp 2 is detachably fitted to the reflector 3 via a socket mechanism 8. The light emitting section of the discharge lamp 2 is located in the vicinity of a first focal point F1 of the reflector 3.

Figure 2:
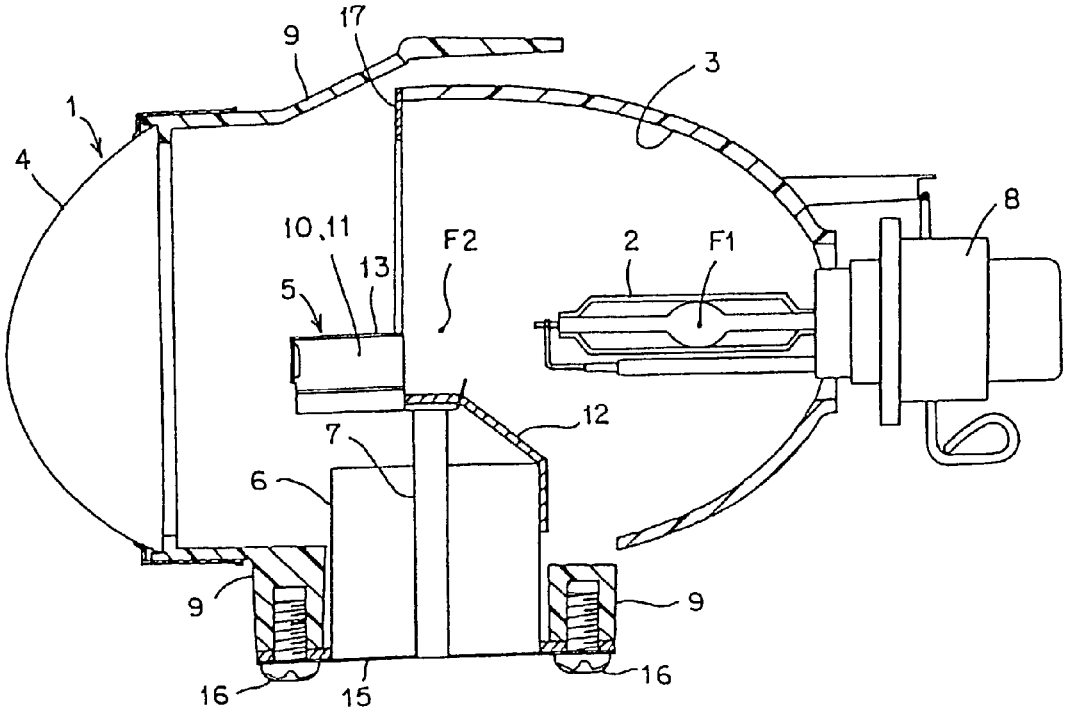
FIG. 2 is a sectional view taken along the line II—II in FIG. 1.
Figure 3:
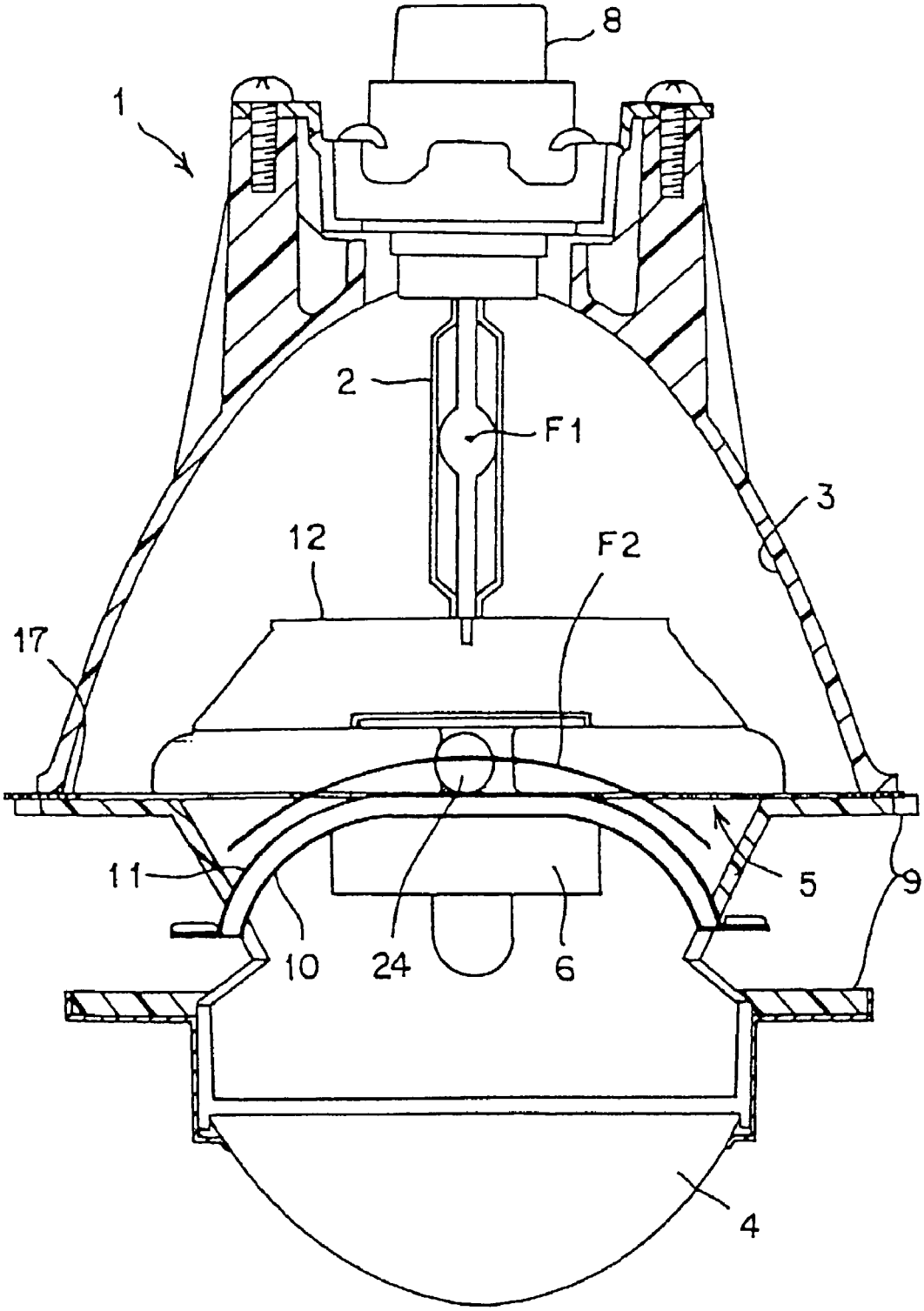
FIG. 3 is a sectional view taken along the line III—III in FIG. 1.
Figure 4:
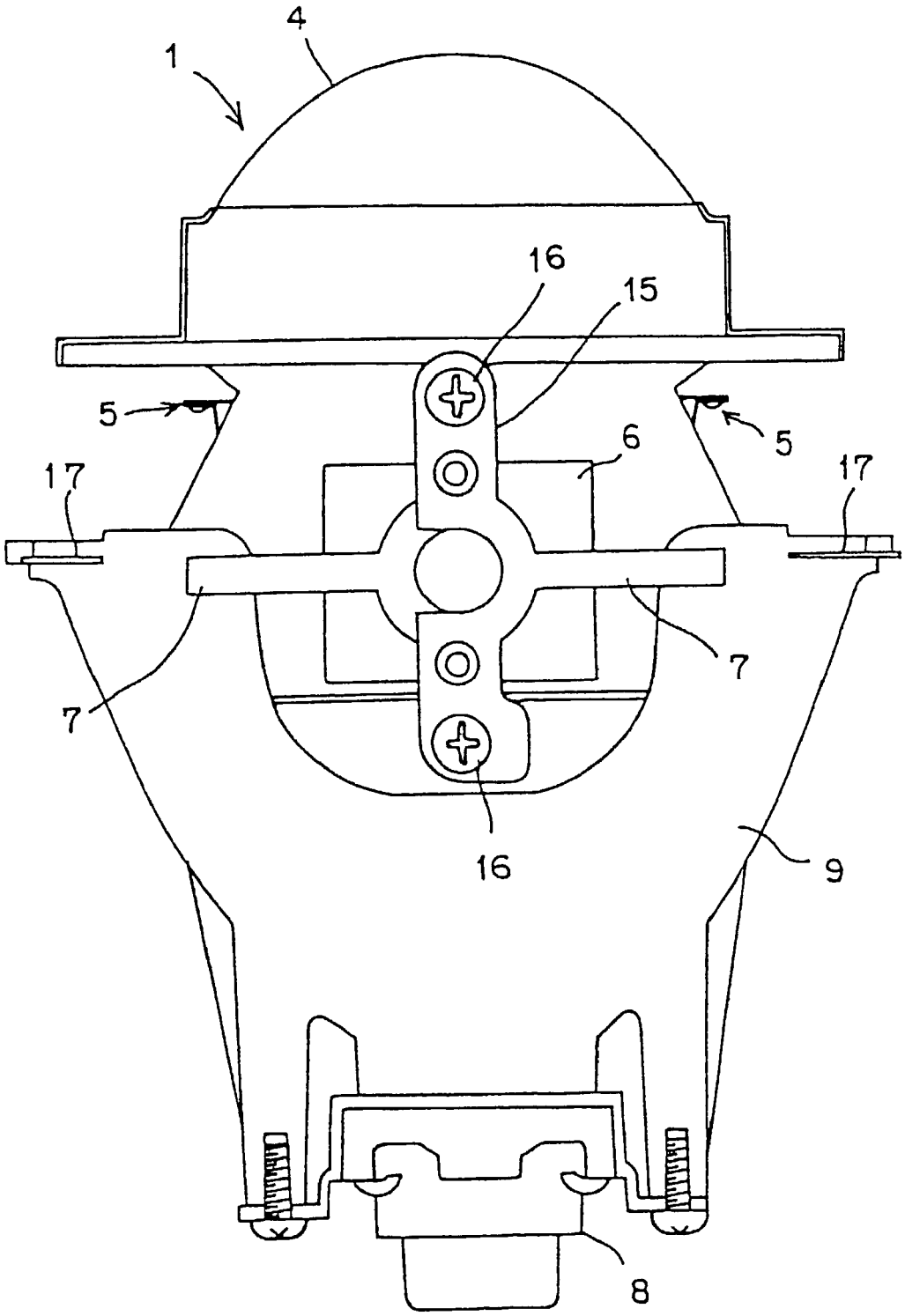
FIG. 4 is a view in the direction of arrow IV in FIG. 1.

The inner concave surface of the reflector 3 comprises a reflecting surface formed by aluminum evaporation or silver plating, such that for example the vertical section in FIG. 2 forms an ellipsoid, and the horizontal section in FIG. 3 forms a paraboloid or a deformed paraboloid. Therefore, the reflecting surface of the reflector 3 has a first focal point F1 and a second focal point (focal line on the horizontal section) F2. The reflector 3 is fixed and held by a holder (or a frame) 9.

The condenser lens 4 has a focal plane (meridional image surface) on the object space side, in the vicinity of the second focal point F2 of the reflector 3 and on the front side than the second focal point F2 (on the condenser lens 4 side with respect to the discharge lamp 2). This focal plane on the object space side is not shown. The condenser lens 4 is fixed and held by the holder 9.

Figure 20A:
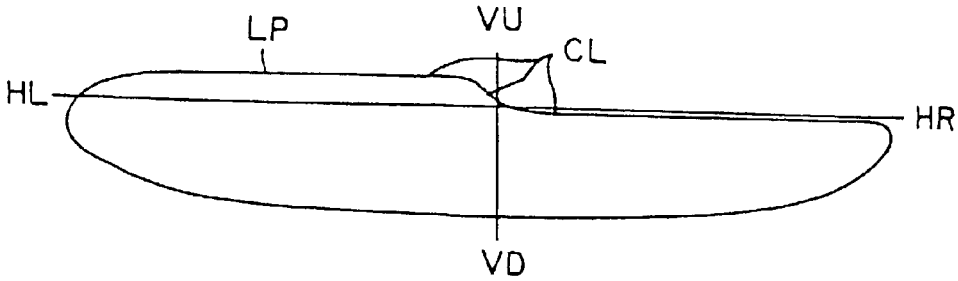
FIG. 20A is a diagram which shows a light distribution pattern for passing by, and FIG. 20B is a diagram which shows a light distribution pattern for driving.
Figure 20B:
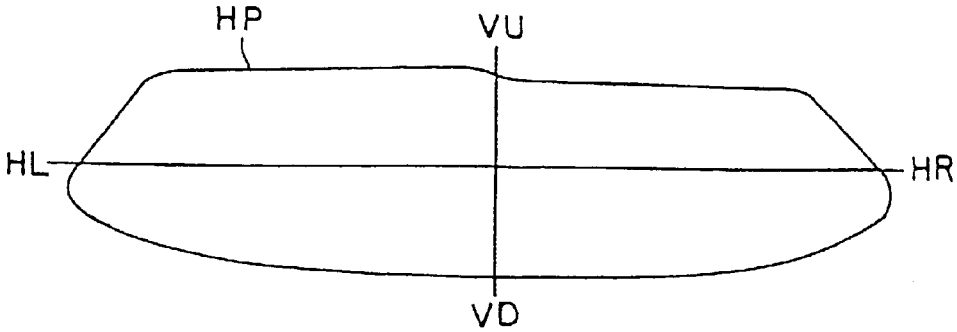

The shade 5 is for switching the irradiated light from the condenser lens 4 to a low beam by which a predetermined light distribution pattern LP for passing by shown in FIG. 20A is obtained, or to a high beam by which a predetermined light distribution pattern HP for driving shown in FIG. 20B is obtained. FIGS. 20A and 20B are diagrams which show light distribution patterns projected onto a screen 10 m ahead from the headlamp 1 in the first embodiment. Reference symbol "HL–HR" in these figures indicates a horizontal line on the right and left on the screen, and reference symbol "VU–VD" indicates a vertical line on the up and down of the screen.

Figure 14:
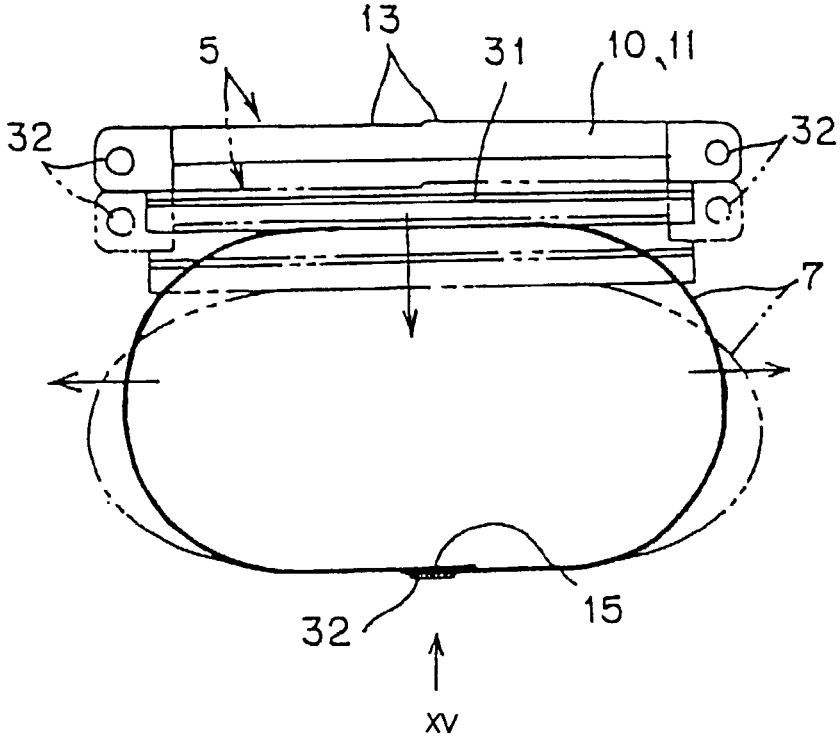
FIG. 14 is a view in the direction of arrow XIV in FIG. 13.
Figure 15:
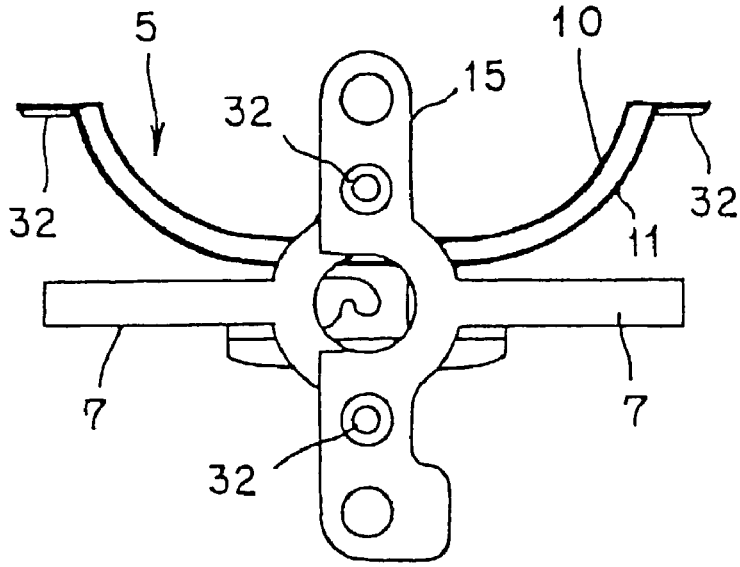
FIG. 15 is a view in the direction of arrow XV in FIG. 14.
Figure 16:
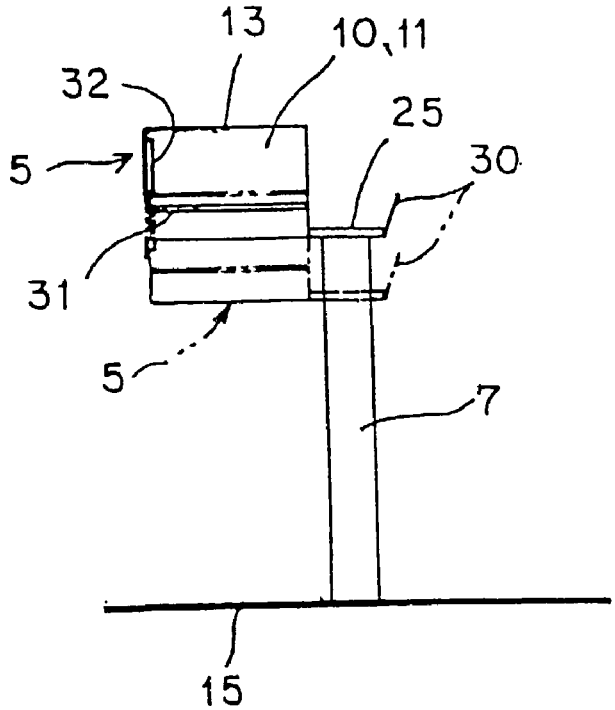
FIG. 16 is a view in the direction of arrow XVI in FIG. 13.

The solenoid 6 and the plate spring 7 as the switching unit are for switching the shade 5 to a low-beam position where the low beam can be obtained (a position shown by a solid line in FIG. 14 and FIG. 16), or to a high-beam position where the high beam can be obtained (a position shown by a two-dot chain line in FIG. 14 and FIG. 16).

The shade 5 comprises movable portions 10 and 11 as a switching portion to switch to the low beam or to the high beam, and a fixed portion 12 as other portions. The movable portions 10, 11 and the fixed portion 12 respectively comprise a thin plate structure having resilience such as a SUS (spring steel sheet). The plate thickness of the movable portions 10 and 11 is thinner than that of the fixed portion 12.

Figure 12A:
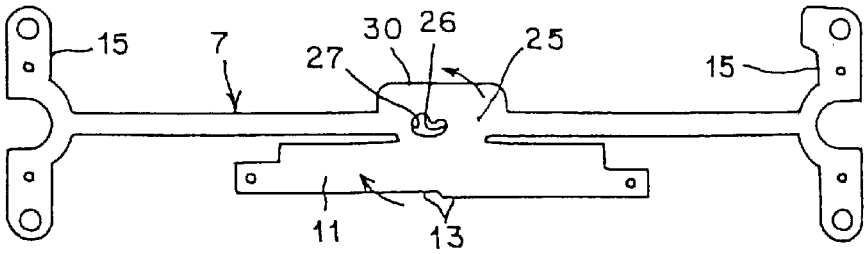
FIG. 12A is a development drawing which shows a movable portion on the rear side of the shade and the plate spring in an integral configuration.
Figure 12B:
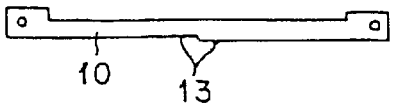
FIG. 12B is a development drawing which shows the movable portion on the front side of the shade.
Figure 12C:
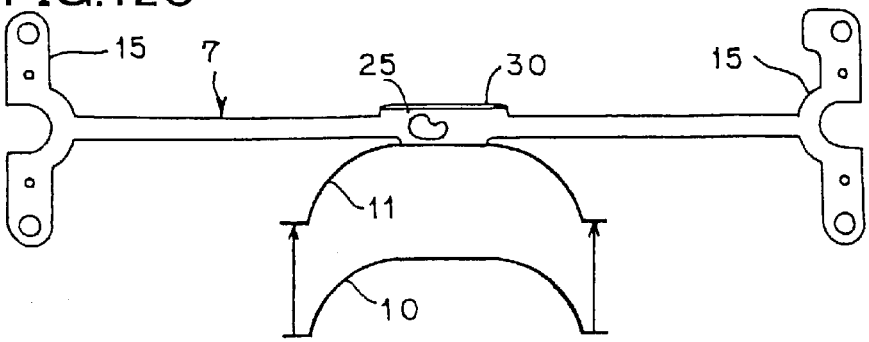
FIG. 12C is a development drawing which shows the state that the movable portion on the rear side of the shade, having the integral configuration with the plate spring, and the movable portion on the front side are riveted together.

The movable portions 10 and 11 are portions which are switched to a low-beam position or to a high-beam position by the solenoid 6 and the plate spring 7. The movable portions 10 and 11 are composed of, as shown in FIG. 12C and FIG. 13, two thin plates (10, 11), which are formed by fixing a thin plate (10) on the front side (on the condenser lens 4 side) and a thin plate (11) on the rear side (on the discharge lamp 2 side) by caulking 32 (or riveting or spot welding).

The size of the movable portions 10 and 11 are the same as that of a stroke of the movable portions 10 and 11 which are moved by switching by the solenoid 6 and the plate spring 7. In this example, as shown in FIG. 14 and FIG. 16, since the movable portions 10 and 11 are moved vertically (in the vertical direction when the headlamp 1 is mounted on a vehicle), the vertical size of the movable portions 10 and 11 is substantially the same as that of the stroke in the vertical movement of the movable portions 10 and 11.

Figure 13:
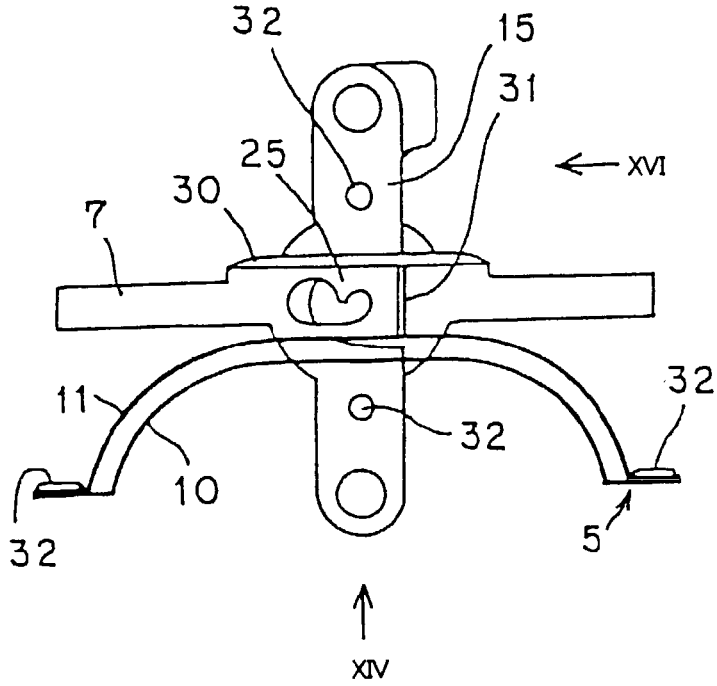
FIG. 13 is a plan view which shows the shade and the plate spring in the integral configuration.

The movable portions 10 and 11 have, as shown in FIG. 3 and FIG. 13, a curved shape as seen from the above, such that the central portion protrudes towards the discharge lamp 2 side.

An edge portion 13 of the shade 5, which forms a cut line CL of the light distribution pattern LP for passing by, is formed respectively on the upper edge of the two thin plates, that is, the movable portions 10 and 11. The edge portion 13 has, as shown in FIG. 1 and FIG. 14, a difference in level slanting by about 45° at the center. By this difference in level, as shown in FIG. 20A, in the light distribution pattern LP for passing by, a cut line slanting by about 45° is formed between the driving lane and the opposing lane.

Figure 17:
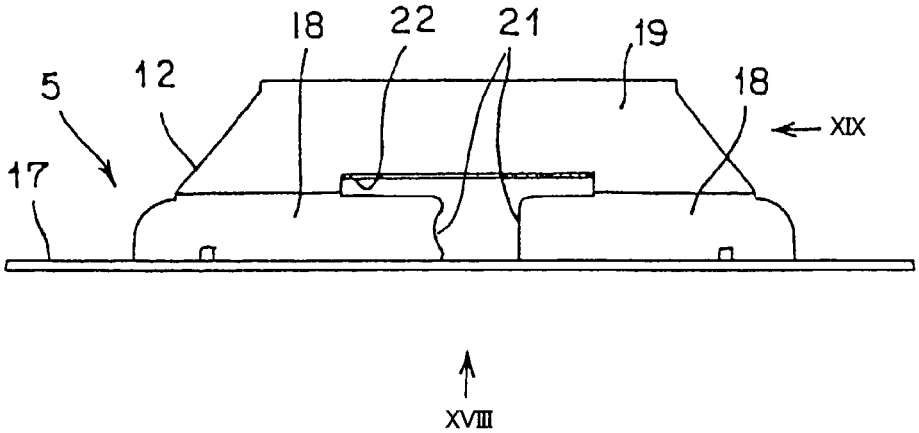
FIG. 17 is a plan view which shows a fixed portion of the shade.
Figure 18:
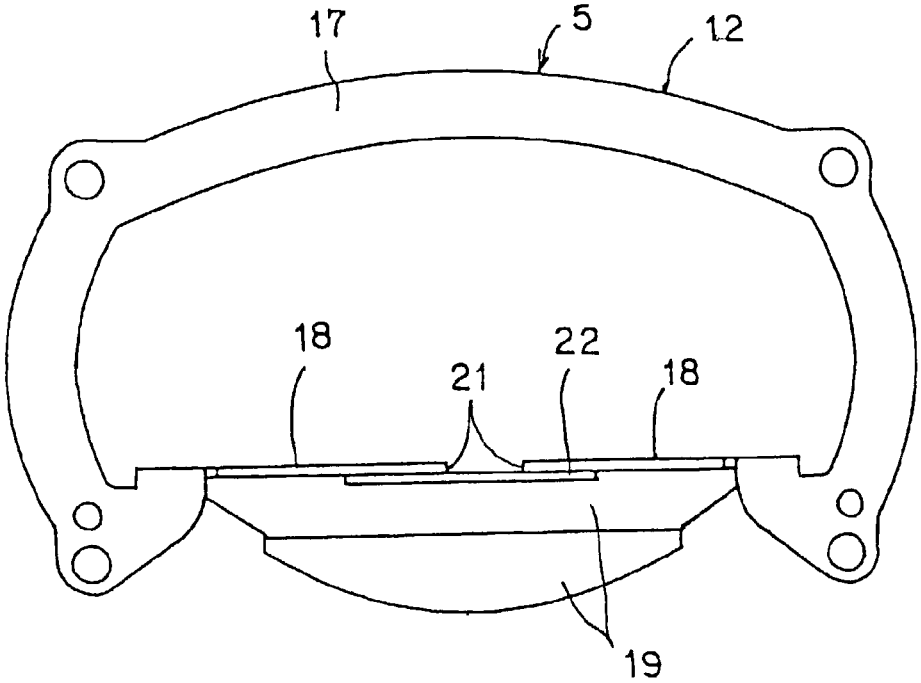
FIG. 18 is a view in the direction of arrow XVIII in FIG. 17.
Figure 19:
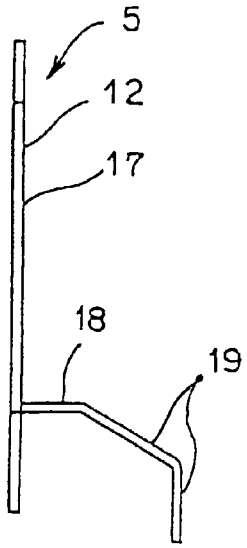
FIG. 19 is a view in the direction of arrow XIX in FIG. 17.

The fixed portion 12 is a portion fixed to the holder 9. The fixed portion comprises, as shown in FIG. 17 to FIG. 19, a ring-shaped fixed part 17 in which a part thereof (lower portion) is notched as seen from the front, a flat-shaped stopper section 18 arranged substantially horizontally in this notched portion of this fixed part 17, and a shade portion 19 formed by being bent obliquely and substantially vertically from the stopper section 18.

The fixed part 17 is fixed by a screw 20 with being put between the holder 9 and the reflector 3. The stopper section 18 is a stopper which restricts the low-beam position of the shade 5 at the time of cutting the electricity to the solenoid 6 (at the time of cutting off charging with electricity). A notch 21 is provided at the center of this stopper section 18. One side of the notch 21 forms a straight line and the other forms a circular arc. The shade portion 19 has a function of intercepting the reflected light from the reflector 3 and a function of intercepting heat from the discharge lamp 2 with respect to the solenoid 6. A rectangular long notch 22 is provided at the center of a joint of the shade portion 19 and the stopper section 18.

The solenoid 6 has a columnar plunger (an advancing and retreating rod) 14 that can advance and retreat. The solenoid 6 is fixed to the holder 9 together with the plate spring 7 by screws 16, and arranged below the movable portions 10 and 11 of the shade 5. A mounting portion 24 is provided at the tip (the upper end) of the plunger 14 of the solenoid 6, via a neck portion 23 narrowed in the middle. This neck portion 23 and the mounting portion 24 are, for example, in a short columnar shape. The diameter (the size) of the mounting portion 24 is larger than the diameter of the neck portion 23 and smaller than that of the plunger 14. The mounting portion 24 is directly fitted to the plate spring 7 which is integral with the movable portions 10 and 11 of the shade 5.

The solenoid 6 is for making the plunger 14 retreat against a spring force of the plate spring 7 by a driving force when the electric supply is ON, to thereby linearly switch the movable portions 10 and 11 of the shade 5 from the low-beam position to the high-beam position and hold these in the high-beam position. As the solenoid 6, a pull type (tension type or retractable type) solenoid which is cheap and efficient can be used. At the time of cutting the electricity, the plunger 14 of the solenoid 6 is in a free condition. In other words, the plunger 14 can freely advance or retreat (vertically movable).

Figure 5:
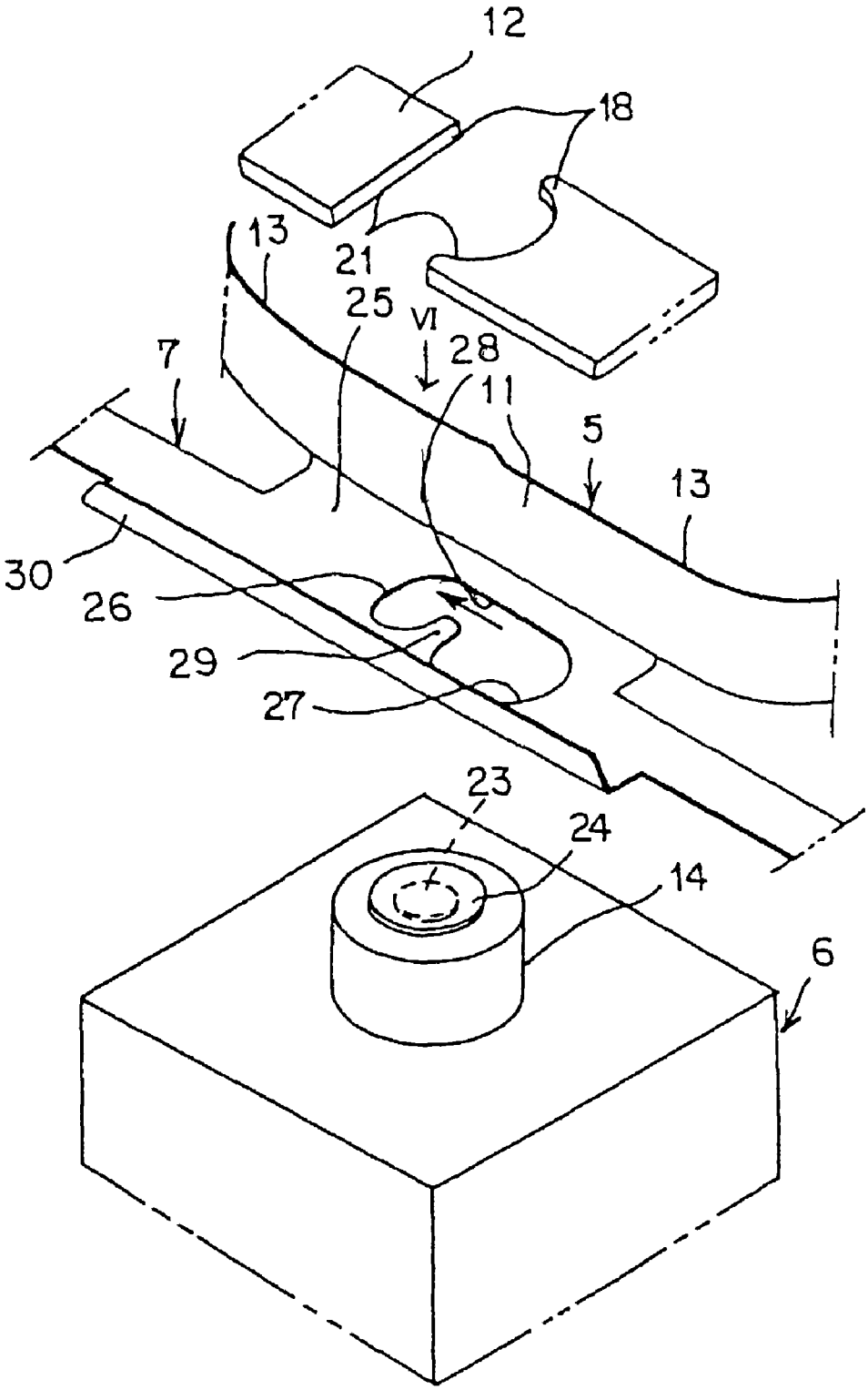
FIG. 5 is a partially exploded perspective view which shows a shade, a plate spring, a solenoid and a stopper section.

In this example, the plate spring 7 comprises a thin plate structure such as SUS (spring steel sheet) having resilience, like the shade 5. As shown in FIG. 1 and FIG. 14, the plate spring 7 has a dome-shaped structure, that is, semicircular portions at the right and left opposite ends and upper and lower linear portions form an integral structure. As shown in FIG. 5 and FIG. 12A, the upper central portion of the plate spring 7 and the central portion at the lower edge of the movable portion 11 on the rear side of the shade 5 are coupled to each other.

In other words, the movable portion 11 on the rear side of the shade 5 having a thin plate structure and the plate spring 7 also having a thin plate structure are integrally formed by press working or the like (see FIG. 12A). On the other hand, the movable portion 10 on the front side of the shade 5 having a thin plate structure is separately formed by press working or the like (see FIG. 12B). The movable portion 11 on the rear side integral with the plate spring 7 and the separate movable portion 10 on the front side are fixed by caulking 32 (see the arrow of a solid line in FIG. 12C). Thereby, the shade 5 composed of two movable portions 10 and 11 and the plate spring 7 form an integral structure.

The plate spring 7 is for linearly switching the movable portions 10 and 11 of the shade 5 from the high-beam position to the low-beam position and holding these in the low-beam position by a spring force, at the time of cutting the electricity to the solenoid 6.

Mounting portions 15 are provided integral with the plate spring 7 so as to be orthogonal to each other, at the central portion on the lower side of the plate spring 7. The mounting portions 15 are fixed to the holder 9 together with the solenoid 6 by the screws 16. The mounting portions 15 are respectively formed, as shown in FIG. 12A and FIG. 12C, at the opposite ends of the plate spring 7, which are overlapped on each other to make the plate spring 7 curve in a dome shape, and are fixed by caulking 32. In FIG. 13, FIG. 14 and FIG. 16, reference numeral 31 denotes beads (ruggedness in a small semicircular shape in section) for reinforcement provided in the shade 5 and the plate spring 7.

A thin plate 25 is provided on the side of the shade 5 and the plate spring 7. In other words, the thin plate 25 is formed of the upper central portion of the plate spring 7, and is formed in a flat plate shape substantially orthogonal to the switching direction (vertical direction) of the shade 5. As shown in FIG. 5 and FIG. 6, the thin plate 25 is provided with a first hole 26, a second hole 27, a third hole 28, a latch 29, and a stopper piece 30.

The diameter of the first hole 26 is larger than that of the neck portion 23, and smaller than that of the mounting portion 24. The first hole 26 is a hole to engage the upper face of the peripheral edge of the first hole 26 with the lower face of the mounting portion 24.

The diameter of the second hole 27 is larger than that of the neck portion 23 and the mounting portion 24. The second hole 27 is a hole for the mounting portion 24 and the neck portion 23 to be inserted therein so that the neck portion 23 is located from the second hole 27 to the first hole 26.

The width of the third hole 28 is larger than the diameter of the neck portion 23 and smaller than that of the mounting portion 24. The third hole 28 is provided between the first hole 26 and the second hole 27, facing the latch 29. This third hole 28 is a guiding hole which guides the neck portion 23 from the second hole 27 to bypass the latch 29, and to be located in the first hole 26.

The latch 29 is provided between the edge of the first hole 26 and the edge of the second hole 27, crosswise with respect to the moving direction of the neck portion 23 from the second hole 27 to the first hole 26 (in the direction of an arrow of a solid line in FIG. 5). The latch 29 is for restricting that the neck portion 23 located in the first hole 26 moves in the direction opposite to the moving direction, to thereby prevent the engagement state of the peripheral edge of the first hole 26 with the mounting portion 24 from coming off. The moving direction agrees with the direction that the semicircular portions at the opposite ends of the plate spring 7 elastically deform from the inside towards the outside (in the direction shown by an arrow of a solid line in FIG. 14), and from the outside towards the inside.

The stopper piece 30 is formed by being bent substantially vertically at the edge of the thin plate 25, opposite to the edge where the movable portion 11 is located. This stopper piece 30 is inserted in the long notch 22, when the shade 5 is in the low-beam position.

A mounting method of the shade 5 and the plate spring 7 to the plunger 14 side of the solenoid 6 will be explained below, with reference to FIG. 6. The solenoid 6 and the plate spring 7 are respectively fixed to the holder 9, so that at the time of completion of fitting, the center O of the neck portion 23 substantially agrees with the center O1 of the first hole 26.

The thin plate 25 on the plate spring side 7 is set on the neck portion 23 and the mounting portion 24 on the plunger 14 side. In this set condition, the thin plate 25 is moved in the direction of an arrow of a solid line, against an elastic force (spring force) of the plate spring 7 (see FIG. 6A).

Figure 6A:
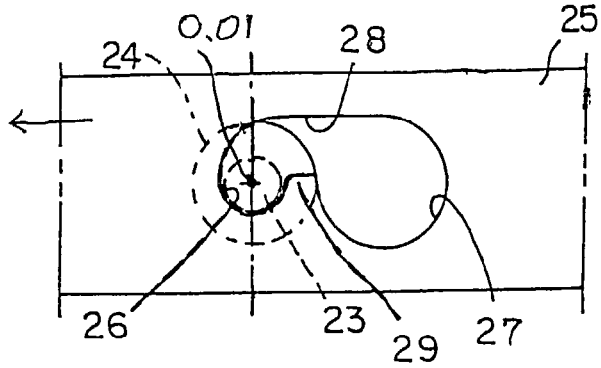
FIG. 6A is a view in the direction of arrow VI in FIG. 5, which shows the state that a thin plate is set on a neck portion and a mounting portion.
Figure 6B:
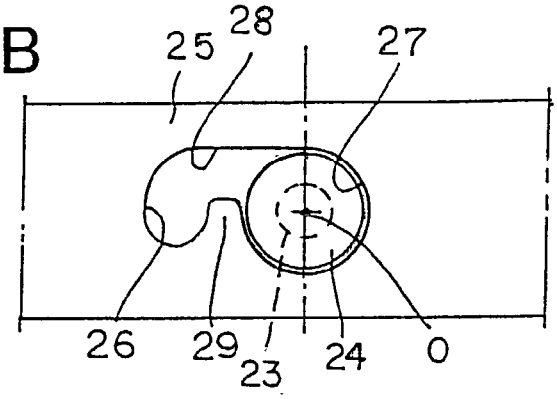
FIG. 6B is a diagram which shows the state that the neck portion and the mounting portion are inserted into a second hole.

The second hole 27 is located on the mounting portion 24 and the neck portion 23, and the mounting portion 24 and the neck portion 23 are inserted into the second hole 27 (see FIG. 6B).

Figure 6C:
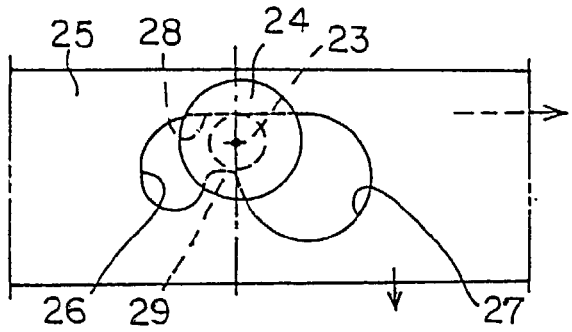
FIG. 6C is a diagram which shows the state that the neck portion is moved from the second hole to a third hole.
Figure 6D:
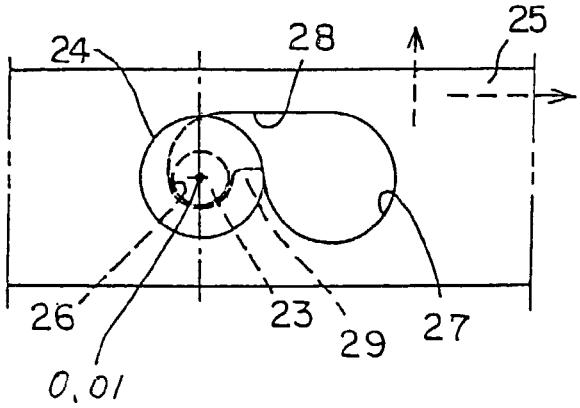
FIG. 6D is a diagram which shows the state that the neck portion is located in a first hole.

The thin plate 25 is moved in the direction of the arrow of a solid line against the elastic force of the plate spring 7, while being made to return in the direction of an arrow of a broken line by an elastic returning force (spring force) of the plate spring 7, so that the neck portion 23 is made to bypass the latch 29 along from the second hole 27 to the third hole 28 (see FIG. 6C).

When the neck portion 23 has just bypassed the latch 29, the thin plate 25 is returned to two directions shown by the broken lines, by the elastic returning force of the plate spring 7. The neck portion 23 is thereby located in the first hole 26 (see FIG. 6D). At this time, the neck portion 23 is restricted from moving from the first hole 26 to the second hole 27 by the latch 29, and hence the fitted state of the side of the shade 5 and the plate spring 7 with the plunger 14 side of the solenoid 6 is prevented from coming off.

As described above, in the headlamp 1 according to the first embodiment, the side of the shade 5 and the plate spring 7 can be fitted to the plunger 14 side of the solenoid 6, without using fittings such as an E ring, and the fitted state does not easily come off.

Figure 7:
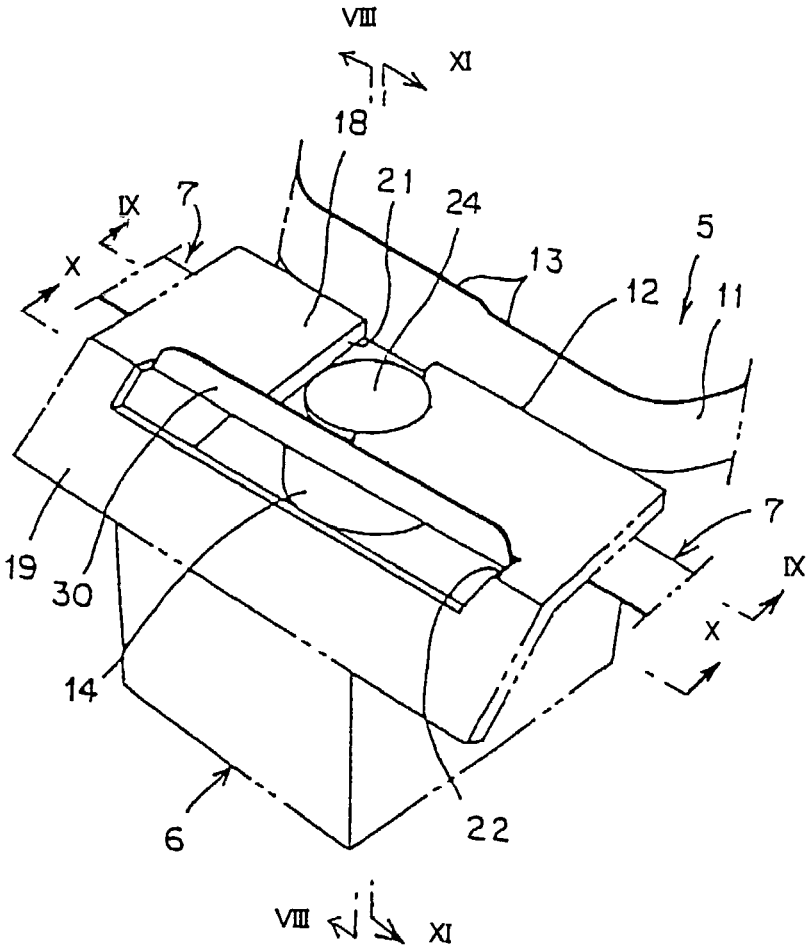
FIG. 7 is a partially exploded perspective view which shows the state that the shade, the plate spring, the solenoid and the stopper section are assembled.
Figure 8:
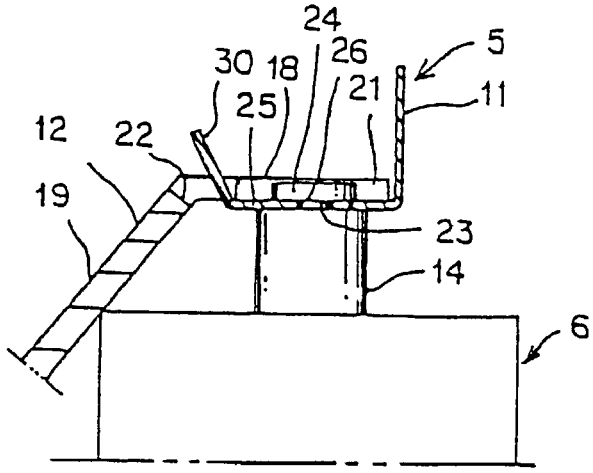
FIG. 8 is a sectional view taken along the line VIII—VIII in FIG. 7.
Figure 9:
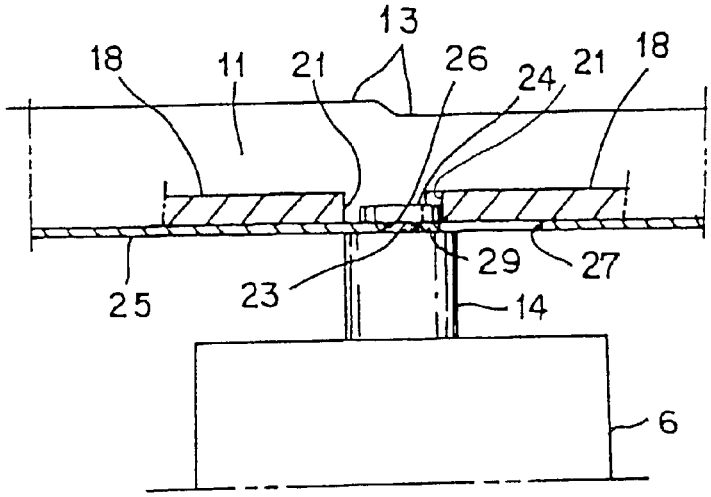
FIG. 9 is a sectional view taken along the line IX—IX in FIG. 7.
Figure 10:
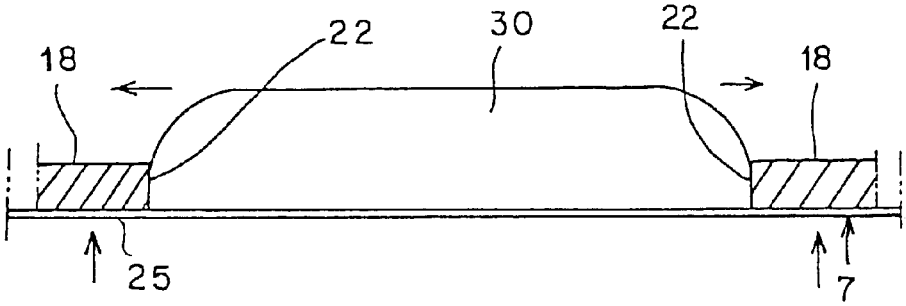
FIG. 10 is a sectional view taken along the line X—X in FIG. 7.
Figure 11:
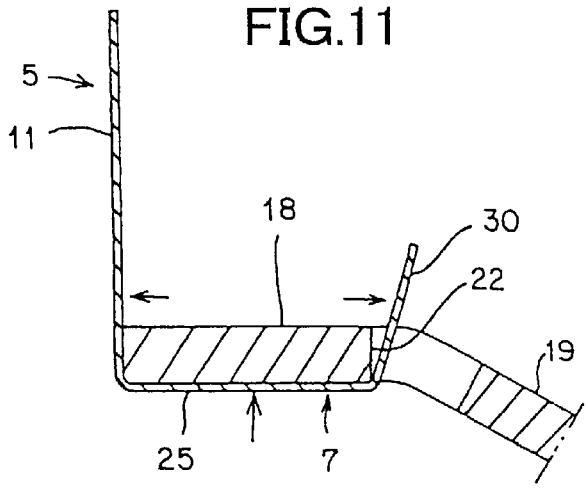
FIG. 11 is a sectional view taken along the line XI—XI in FIG. 7.

At the time of cutting the electricity to the solenoid 6, the stopper section 18 of the fixed portion 12 is placed on the thin plate 25 of the plate spring 7 fitted with the plunger 14. Then, as shown in FIG. 7, FIG. 8 and FIG. 11, the stopper section 18 is put between the movable portion 11 on the rear side of the shade 5 and the stopper piece 30 of the plate spring 7. The mounting portion 24 of the plunger 14 is located, as shown in FIG. 7 and FIG. 9, at the circular notch 21 of the stopper section 18. Further, the stopper piece 30 of the plate spring 7 is, as shown in FIG. 7 and FIG. 10, inserted in the long notch 22 of the fixed portion 12. As a result, the stopper section 18 restricts that the neck portion 23 and the thin plate 25 relatively move in the direction of the latch 29 being provided (in FIG. 5, crosswise direction with respect to the direction shown by the arrow of a solid line).

In the headlamp 1 according to this embodiment, there are equipped a first restriction unit, a second restriction unit, and a third restriction unit, which respectively restrict the low-beam position of the shade 5 in three directions substantially orthogonal to each other.

The first restriction unit is constituted of the thin plate 25 provided in the shade 5 and the plate spring 7 on the movable side, and the stopper section 18 provided in the fixed portion 12 on the fixed side with respect to the movable side. When the shade 5 is switched from the high-beam position to the low-beam position, as shown in FIG. 10 and FIG. 11, the upper face of the thin plate 25 abuts against the lower face of the stopper section 18. Thereby, the low-beam position of the shade 5 is restricted in the switching direction of the shade 5.

The second restriction unit is constituted of the stopper section 18 on the fixed side and two clamping pieces provided on the movable side, that is, the movable portion 11 on the rear side of the shade 5 and the stopper piece 30. When the shade 5 is switched from the high-beam position to the low-beam position, as shown in FIG. 11, the stopper section 18 is put between the movable portion 11 on the rear side of the shade 5 and the stopper piece 30. Thereby, the low-beam position of the shade 5 is restricted in the direction substantially orthogonal to the restriction direction of the first restriction unit.

The third restriction unit is constituted of wall faces at the opposite ends of the long notch 22 provided on the fixed side and opposite end faces of the stopper piece 30. When the shade 5 is switched from the high-beam position to the low-beam position, as shown in FIG. 10, the stopper piece 30 is inserted in the long notch 22. By the wall faces at the opposite ends of the long notch 22 and the opposite end faces of the stopper piece 30, the low-beam position of the shade 5 is restricted in the direction substantially orthogonal to the restriction direction of the first restriction unit and the restriction direction of second restriction unit.

The discharge lamp 2, the reflector 3, the condenser lens 4, the shade 5, the solenoid 6, the plate spring 7, the socket mechanism 8 and the holder 9, being the components of the headlamp 1, are arranged in a lamp chamber (not shown) divided by an outer lens or an outer cover (not shown), and a lamp housing (not shown), to thereby form the headlamp 1.

The headlamp 1 according to this embodiment is constituted as described above. The operation thereof will be explained below.

The discharge lamp 2 is lighted. The light from the discharge lamp 2 is reflected by the reflector 3. The reflected light is condensed at the second focal point F2 of the reflector 3, and diffused through the second focal point F2, and further irradiated forward through the condenser lens 4. The irradiated light is irradiated forward respectively, as a low beam by which the predetermined light distribution pattern LP for passing by shown in FIG. 20A is obtained, and as a high beam by which the predetermined light distribution pattern HP for driving shown in FIG. 20B is obtained.

At the time of cutting the electricity to the solenoid 6, as shown in FIG. 8 and FIG. 9, the plunger 14 of the solenoid 6 is in the advanced state (extended state) by the spring force of the plate spring 7, and the upper face of the thin plate 25 abuts against the lower face of the stopper section 18. The movable portions 10 and 11 of the shade 5 are in the low-beam position shown by a solid line in FIG. 14 and FIG. 16, and this low-beam position is being kept.

At this low-beam position, as described below, the position is restricted in the three directions by the first restriction unit, the second restriction unit and the third restriction unit. As a result, with the headlamp 1 according to this first embodiment, the low-beam position of the shade 5 can be position-restricted at high accuracy, without requiring highly accurate tolerance with respect to the solenoid 6, and hence the predetermined light distribution pattern LP for passing by can be obtained at high accuracy. In other words, the switching direction (vertical direction) of the shade 5 is restricted by the spring force of the plate spring 7 and the stopper operation of the stopper section 18, being the first restriction unit. The width direction of the stopper section 18 substantially orthogonal to the switching direction of the shade 5 is restricted by the stopper section 18, and the movable portion 11 and the stopper piece 30 which put the stopper section 18 therebetween, being the second restriction unit. Further, the direction of elastic deformation of the plate spring 7, which is substantially orthogonal to the switching direction of the shade 5 and the width direction of the stopper section 18, is restricted by the wall faces at the opposite ends of the long notch 22 and the opposite end faces of the stopper piece 30 inserted in the long notch 22, being the third restriction unit.

As a result, of the reflected light, the reflected light advancing substantially to the upper half of the condenser lens 4 is cut off by the movable portions 10 and 11 of the shade 5, and irradiated forward as a low beam. Therefore, as shown in FIG. 20A, the predetermined light distribution pattern LP for passing by can be obtained.

The solenoid 6 is then charged with electricity. The plunger 14 of the solenoid 6 then retreats against the spring force of the plate spring 7. Accompanying this, the movable portions 10 and 11 of the shade 5 come down linearly, and the position of the shade 5 is switched from the low-beam position shown by the solid line in FIG. 14 and FIG. 16 to the high-beam position shown by the two-dot chain line in FIG. 14 and FIG. 16.

As a result, the reflected light advances over the whole surface of the condenser lens 4, and is irradiated forwards as a high beam. Accordingly, as shown in FIG. 20B, the predetermined light distribution pattern HP for driving can be obtained.

Charging of electricity to the solenoid 6 is then cut off. The plate spring 7, which is in a bent state shown by the two-dot chain line in FIG. 14 and FIG. 16, elastically returns to the original state shown by the solid line in FIG. 14 and FIG. 16. Accompanying this, the plunger 14 of the solenoid 6 advances. The movable portions 10 and 11 of the shade 5 go up linearly together with the advancement, and the position of the shade 5 is switched from the high-beam position shown by the two-dot chain line in FIG. 14 and FIG. 16 to the low-beam position shown by the solid line in FIG. 14 and FIG. 16. As a result, as shown in FIG. 20A, the predetermined light distribution pattern LP for passing by can be obtained.

The headlamp 1 in this first embodiment has the above-described configuration, and the effects thereof will be explained below.

In the headlamp 1 according to the first embodiment, the shade 5 comprises a thin plate structure, and hence the weight of the shade 5 can be reduced. Thereby, the driving force of the solenoid 6 and the spring force of the plate spring 7, as the units which switch the shade 5 either to the low-beam position or to the high-beam position, can be made small. Accordingly, a cheap solenoid 6 having a small driving force and a cheap spring member 7 having a small spring force can be used, thereby enabling reduction in the production cost. Since the weight of the shade 5 is light, the switching operation of the shade 5 can be performed easily and accurately by the solenoid 6 and the plate spring 7. Hence, accurate switching between the low beam and the high beam becomes possible.

In the headlamp 1 according to the first embodiment, the shade 5 is switched to the high-beam position by the driving force of the solenoid 6 and maintained in this position, and on the other hand, the shade 5 is switched to the low-beam position by the spring force of the plate spring 7 and maintained in this position. Thereby, a pull-type solenoid 6 which is cheap and efficient can be used as the solenoid 6. As a result, the production cost can be reduced, and the low beam and the high beam can be accurately switched.

In the headlamp 1 according to the first embodiment, since the solenoid 6 and the plate spring 7, being the switching units, are directly fitted to the shade 5, the configuration of the solenoid 6 and the plate spring 7, being the switching units, becomes simpler compared to one in which a driving force transmission unit is provided between the solenoid and the shade. Hence, the production cost can be reduced. Further, since the configuration of the solenoid 6 and the plate spring 7, being the switching units, is simple, the switching operation of the shade 5 can be easily and accurately performed, thereby enabling accurate switching between the low beam and the high beam.

In the headlamp 1 according to the first embodiment, since the solenoid 6 is arranged below the shade 5, when the shade 5 is dropped against the spring force of the plate spring 7 at the time of charging with electricity, the weight of the shade 5 works. Therefore, the driving force of the solenoid 6 needs only be slightly larger than the spring force of the plate spring 7. Therefore, a cheap solenoid 6 having a small driving force can be used. On the other hand, the spring force of the plate spring 7 needs only be a force for supporting the weight of the shade 5 and the weight of the plunger 14 of the solenoid 6 at the time of normal operation, and a force for raising the shade 5 and the plunger 14 to be returned to the original position at the time of cutting electricity. Therefore, a cheap spring member 7 having a small spring force can be used. Thereby, the production cost can be also reduced.

In the headlamp 1 according to the first embodiment, the plunger 14 of the solenoid 6 and the plate spring 7 are directly fitted to the shade 5 respectively, to thereby linearly move the shade 5 vertically by driving force of the solenoid 6 and the spring force of the plate spring 7. Therefore, the switching operation of the shade 5 can be easily and accurately performed, thereby enabling accurate switching between the low beam and the high beam.

In the headlamp 1 according to the first embodiment, at the time of normal operation, the shade 5 is in the low-beam position by the spring force of the plate spring 7, and at the time of charging the solenoid 6 with electricity, the shade 5 is in the high-beam position by the driving force of the solenoid 6. Therefore, when the shade 5 is in the high-beam position, if any failure occurs in the solenoid 6 and the electric system, the driving force of the solenoid 6 becomes zero, and the shade 5 is automatically returned from the high-beam position to the low-beam position by the spring returning force of the plate spring 7. Therefore, the fail-safe function is equipped.

In the headlamp 1 according to the first embodiment, since the shade 5 and the plate spring 7 are integrally formed, the number of parts can be reduced, and hence the production cost can be also reduced.

In the headlamp 1 according to the first embodiment, since the shade 5 and the plate spring 7 have an integral structure of a thin steel plate, the heat of the reflected light from the reflector 3 can be efficiently radiated. In other words, in the shade 5 that intercepts the reflected light from the reflector 3, even if the heat of the reflected light is concentrated, the heat is transmitted to the plate spring 7 through the shade 5, and is efficiently radiated in the plate spring 7 by the heat dissipating action. Thereby, since the solenoid 6 can be protected from the heat of the reflected light from the reflector 3, a decrease of the driving force of the solenoid 6 due to heat can be prevented. As a result, a cheap solenoid 6 having a small driving force can be used, thereby enabling reduction in the production cost.

In the headlamp 1 according to the first embodiment, since the plate spring 7 has a dome-shaped structure, the vibration resistance can be improved.

In the headlamp 1 according to the first embodiment, the plate spring 7 having a dome-shaped structure is used, in which two semicircular portions are coupled with each other. Therefore, when the plate spring 7 returns by the spring force and reaches the top dead center, the two semicircular portions pull each other, and hence the plate spring 7 stops at the top dead center reliably and within a short period of time. Therefore, vibrations in the direction of the spring action are extremely small, and hence the shade 5 can be stopped at a predetermined position reliably and within a short period of time.

In the headlamp 1 according to the first embodiment, since the shade 5 is divided into the movable portion and the fixed portion, the portion of the shade 5 which is moved by the solenoid 6 and the plate spring 7 is only the movable portion. Therefore, the portion of the shade 5 which is moved can be made small and light in weight, and hence a cheap solenoid 6 having a small driving force and a cheap spring member 7 having a small spring force can be used, thereby enabling reduction in the production cost. Further, by setting the size of the movable portion to be the same size as that of the moving stroke of the movable portion, the predetermined light distribution pattern for passing by and the predetermined light distribution pattern for driving are not affected.

In the headlamp 1 according to the first embodiment, of the shade 5 comprising a thin plate structure, particularly the fixed portion can function also as a heat shielding plate which shields the solenoid 6 against the heat from the discharge lamp 2. Thereby, since the solenoid 6 can be shielded from the heat of the discharge lamp 2, a decrease of the driving force of the solenoid 6 due to the heat can be prevented. As a result, a cheap solenoid 6 having a small driving force can be used, thereby enabling reduction in the production cost.

In the headlamp 1 according to the first embodiment, the portion of the shade 5 which switches between the low beam and the high beam has a curved shape in which the central portion protrudes towards the discharge lamp 2 side, as seen from the above, and the edge portion 13 of the shade 5, which forms a cut line of the light distribution pattern for passing by, is formed by the two thin plates 10 and 11. As a result, by the shade 5 having a thin plate structure, the edge portion 13 comprising the two thin plates 10, 11 can be easily produced. Further, by adequately controlling the positions of the edge portion 13 comprising the two thin plates 10, 11 and the second focal point F2 of the projector type headlamp, spectral colors can be eliminated.

In the headlamp 1 according to the first embodiment, as the reflector 3, the shade 5, the solenoid 6, the plate spring 7, the socket mechanism 8 and the holder 9, being the components, are applied with aluminum evaporation or silver plating, there can be obtained a sealing effect of noise at the time of lighting the discharge lamp 2.

In the headlamp 1 according to the first embodiment, the shade 5 is composed of the movable portions 10 and 11, and the fixed portion 12. Therefore, even if the movable portions 10 and 11 vertically move, the direct light from the discharge lamp 2 and the reflected light from the reflector 3 can be reliably shielded by the fixed portion 12.

In the headlamp 1 according to the first embodiment, the solenoid 6 can be made small. Therefore, as shown in FIG. 1, most part of the solenoid 6 can be housed within a dead space of light distribution (that is, in the space above the line UL of the vehicle frame, which is the lowermost part of the vehicle frame (not shown) to which the headlamp 1 is fitted, and which does not contribute to the formation of the light distribution pattern at all), thereby the amount of the lower part OL of the solenoid 6 protruding from the line UL of the lowermost part of the vehicle frame can be made small. As a result, it is possible to fit the headlamp to various kinds of vehicles. A so-called minor change is possible.

Particularly, in the headlamp 1 according to the first embodiment, the side of the shade 5 and the plate spring 7 can be fitted to the plunger 14 side of the solenoid 6, without using fittings such as an E ring, and the fitted state does not easily come off. As a result, since fittings such as an E ring is not used, the number of mounting parts is reduced, and the assembly process becomes simple, thereby enabling reduction in the production cost.

In the headlamp 1 according to the first embodiment, by the guiding function of the third hole 28, the neck portion 23 can be located in the first hole 26 reliably and easily by bypassing the latch 29 from the second hole 27.

In the headlamp 1 according to the first embodiment, by the stopper section 18, relative movement of the neck portion 23 and the thin plate 25 in the direction of the latch 29 being provided is restricted, and hence the neck portion 23 is completely restricted from moving from the first hole 26 to the second hole 27. Therefore, the fitted state between the side of the shade 5 and the plate spring 7 and the plunger 14 side of the solenoid 6 does not come off at all.

FIG. 21 to FIG. 29 show a second embodiment of the headlamp according to this invention. In these figures, the same reference symbols as in FIG. 1 to FIG. 20 denote the same parts, respectively.

The second embodiment relates to a modification example of the mounting structure between the side of the shade 5 and the plate spring 7 and the plunger 14 side of the solenoid 6. In other words, the thin plate according to the second embodiment comprises a first thin plate bent towards substantially the same direction as the switching direction of the shade 5, and a second thin plate bent towards the direction substantially orthogonal to the switching direction of the shade 5. The first thin plate is a movable portion 11 on the rear side of the shade 5, and the second thin plate is the thin plate 25 in the first embodiment.

The thin plate 25 as the second thin plate is provided with a first hole 33 rectangular as seen from the above. The movable portion 11 as the first thin plate is provided with a second hole 34 in a T shape as seen from the front, continuous from the first hole 33. The movable portion 11 is further provided with a latch 35. The latch 35 is provided in the direction substantially orthogonal to the moving direction of the neck portion 23 from the second hole 34 to the first hole 33 (in the direction shown by an arrow of a solid line and in the width direction of the plate spring 7 in FIG. 23 and FIG. 24).

In the figures, reference symbol 36 denotes a stopper section provided in the fixed portion 12. This stopper section 36 is inclined, and functions in the same manner as the stopper section 18 in the first embodiment. At one end of the stopper section 36, a concave portion 37 is provided.

A fitting method between the side of the shade 5 and the plate spring 7 and the plunger 14 side of the solenoid 6 will be explained below. The solenoid 6 and the plate spring 7 are respectively fixed to the holder 9 to be in the condition shown in FIG. 25 and FIG. 26, at the time of completion of fitting.

Figure 21:
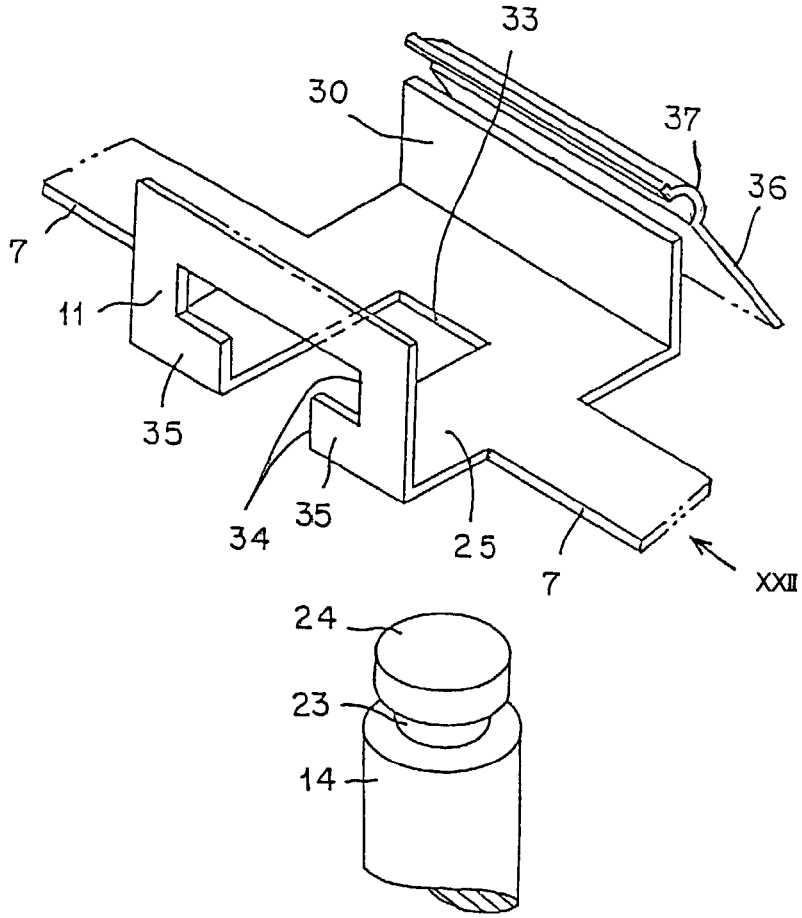
FIG. 21 is a partially exploded perspective view which shows a shade, a plate spring, a solenoid and a stopper section, which shows a second embodiment of the headlamp of this invention.
Figure 22:
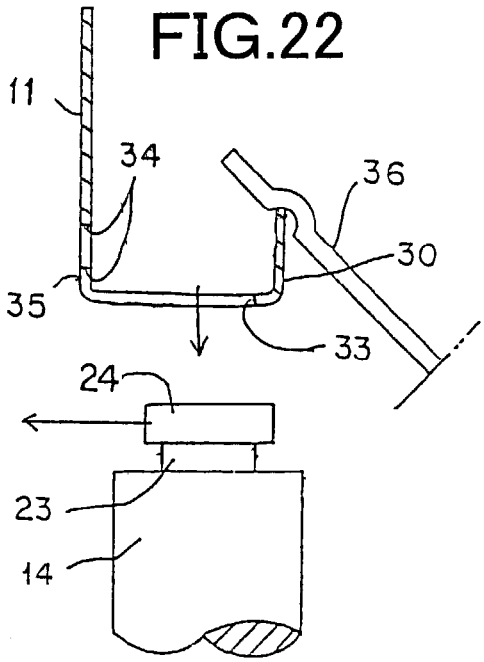
FIG. 22 is a view in the direction of arrow XXII in FIG. 21.

The movable portion 11 as the first thin plate on the side of the shade 5 and the plate spring 7, and the thin plate 25 as the second thin plate are set on the neck portion 23 and the mounting portion 24 of the plunger 14 side (see FIG. 21). In this set condition, the thin plate 25 is moved in the direction of an arrow of a solid line against an elastic force (spring force) of the plate spring 7, and the neck portion 23 and the mounting portion 24 are moved in the direction of an arrow of a solid line (see FIG. 22).

Figure 23:
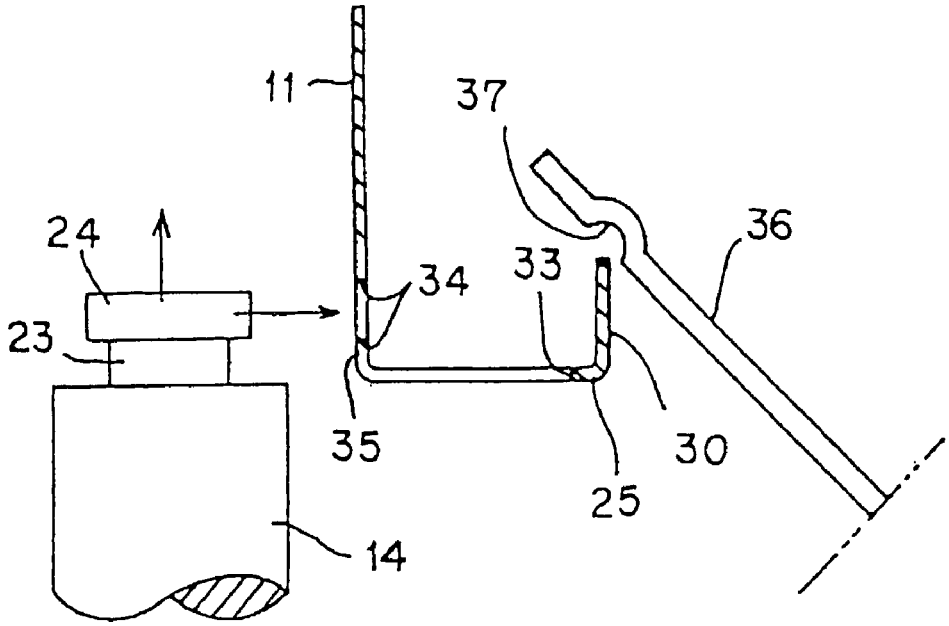
FIG. 23 is a diagram which shows the state that the neck portion and the mounting portion are inserted into the second hole.
Figure 24:
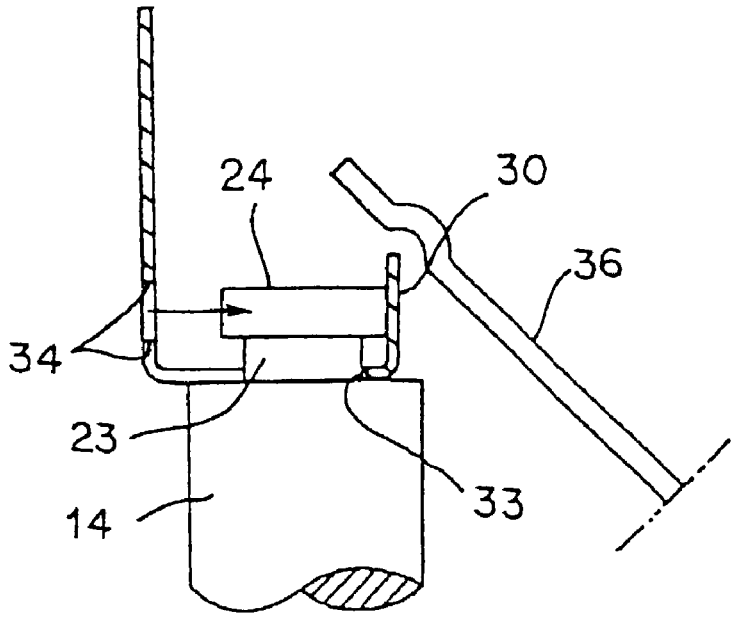
FIG. 24 is a diagram which shows the state that the neck portion is moved from the second hole to the first hole.

The neck portion 23 and the mounting portion 24 are then lifted in the direction of the arrow of a solid line against the weight of the plunger 14, to insert these into the second hole 34, in the direction of the arrow of a solid line (see FIG. 23). Further, the neck portion 23 and the mounting portion 24 are moved in the direction of the arrow of a solid line, from the second hole 34 to the first hole 33, and located there (see FIG. 24).

The plate spring 7 is returned in the direction of an arrow of a broken line by the elastic returning force (spring force). The upper face of the thin plate 25 then abuts against the lower face of the mounting portion 24, and the neck portion 23 is located in the first hole 33 (see FIG. 25 and FIG. 26). At this time, the shade 5 is in the low-beam position, and the upper end of the stopper piece 30 abuts against the concave portion 37 of the stopper section 36, and hence the stopper piece 30 is restricted in the direction of the arrow of a solid line in FIG. 25 due to the inclination of the stopper section 36 and abuts against the mounting portion 24. Since the neck portion 23 is located in the first hole 33, the thin plate 25 is restricted in its movement in the direction of the arrow of a solid line in FIG. 26. As a result, when the shade 5 is in the low-beam position, the fitted state between the side of the shade 5 and the plate spring 7 and the plunger 14 side of the solenoid 6 does not come off.

As described above, in the second embodiment, as in the first embodiment, the side of the shade 5 and the plate spring 7 can be fitted to the plunger 14 side of the solenoid 6, without using fittings such as an E-ring, and the fitted state does not easily come off.

Figure 27:
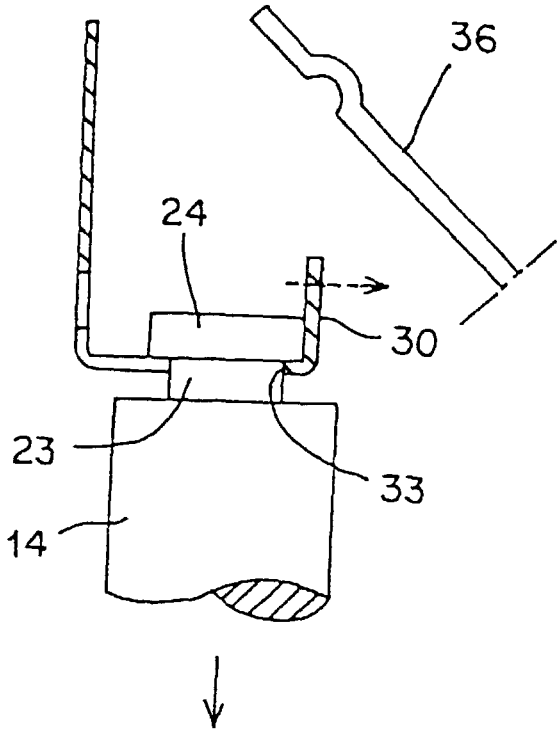
FIG. 27 is a diagram which shows the state that the solenoid is charged with electricity to change the position of the shade from a low-beam position to a high-beam position.

When the solenoid 6 is charged with electricity, the plunger 14 retreats in the direction of the arrow of a solid line, and the shade 5 is switched from the low-beam position to the high-beam position (see FIG. 27). At this time, since the upper end of the stopper piece 30 comes out of the concave portion 37 of the stopper section 36, the plate spring 7 can freely move in the direction of an arrow of a broken line in FIG. 27.

Figure 28:
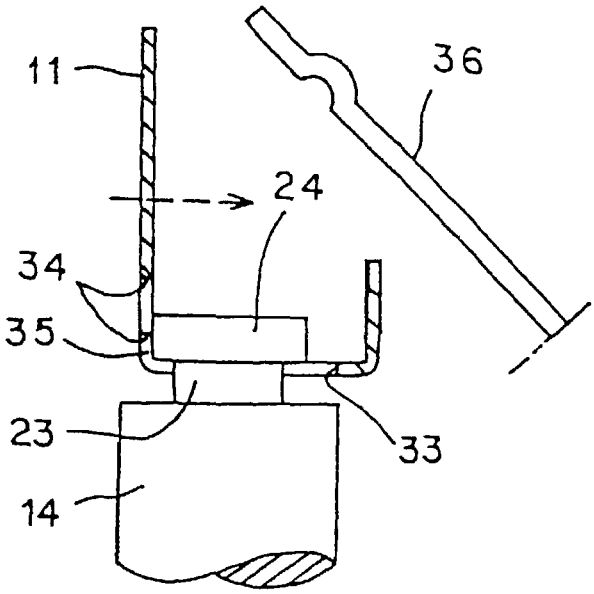
FIG. 28 is a diagram which shows the state that a stopper section is operated.

When the plate spring 7 moves in the direction of the arrow of a broken line in FIG. 27, the mounting portion 24 and the latch 35 abut against each other, thus the movement of the plate spring 7 in the direction of the arrow of a broken line is restricted (see FIG. 28). As a result, when the shade 5 is in the high-beam position, the fitted state between the side of the shade 5 and the plate spring 7 and the plunger 14 side of the solenoid 6 does not come off.

Figure 25:
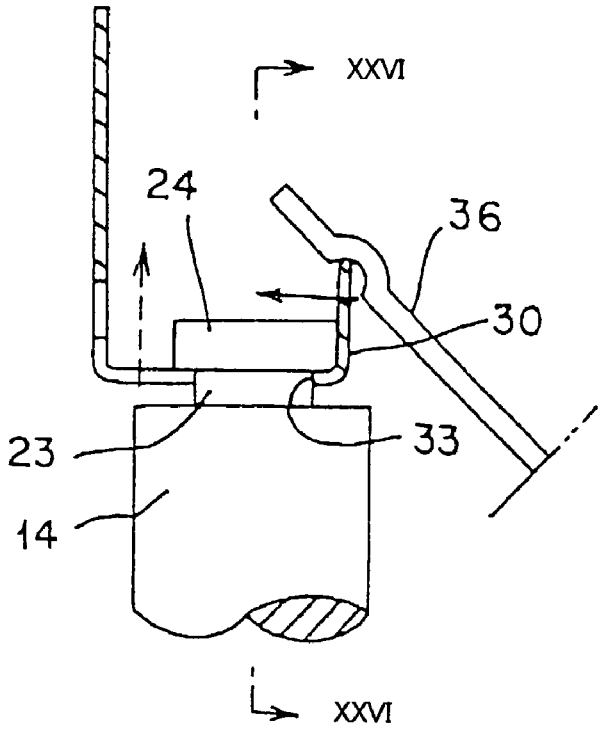
FIG. 25 is a diagram which shows the state that the neck portion is located in the first hole.
Figure 26:
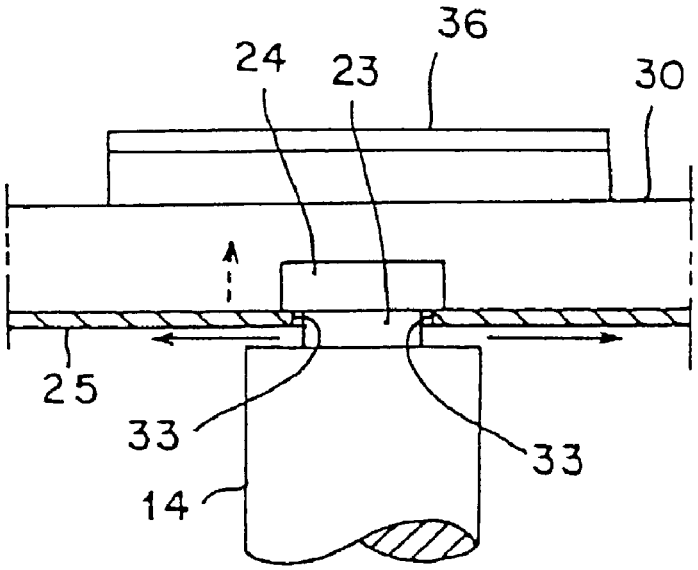
FIG. 26 is a sectional view taken along the line XXVI—XXVI in FIG. 25.
Figure 29:
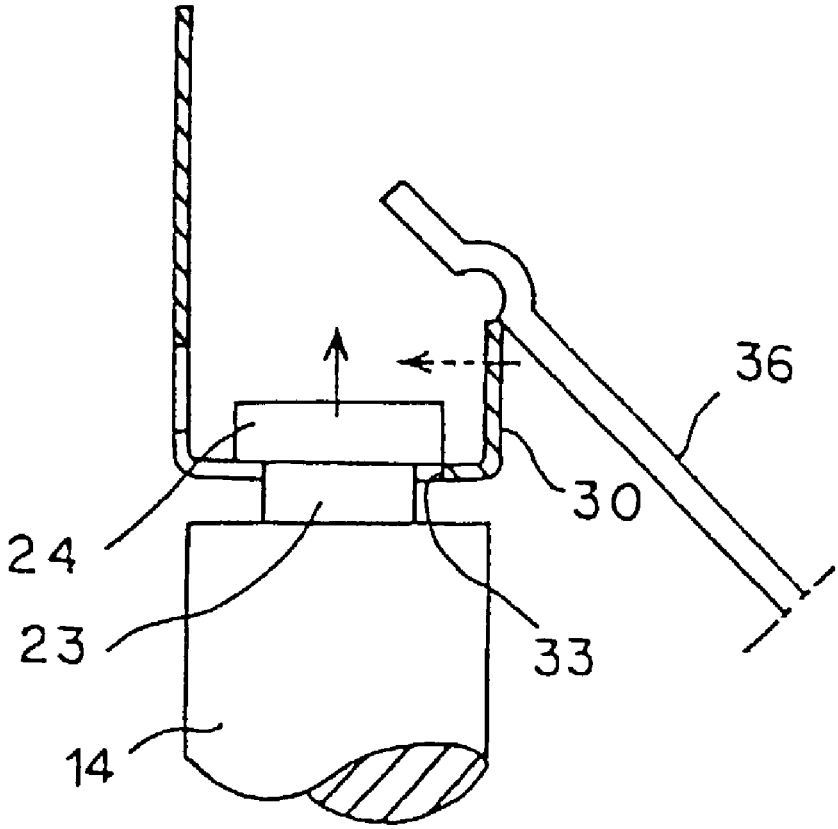
FIG. 29 is a diagram which shows the state that charging of the solenoid with electricity is cut off to change the position of the shade from the high-beam position to the low-beam position.
Figure 30:
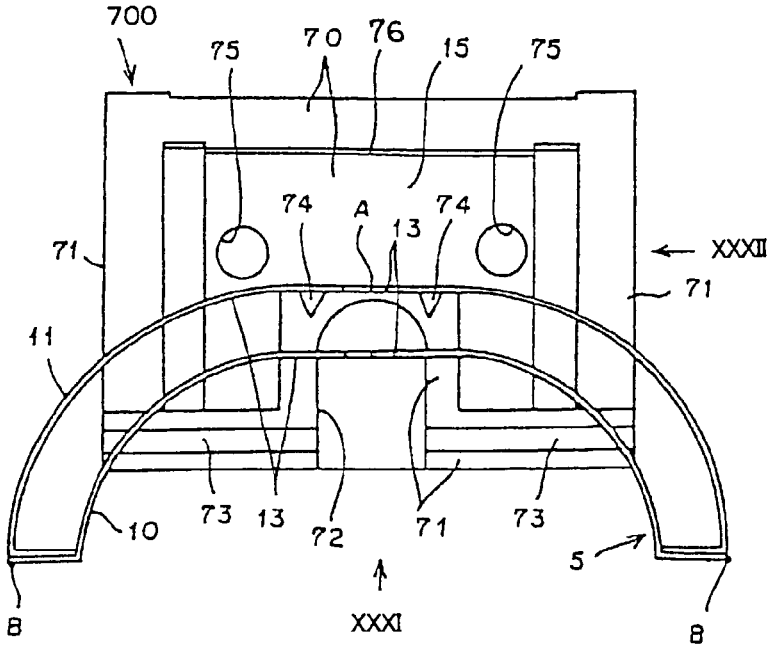
FIG. 30 is a plan view of a shade and a plate spring, which shows a third embodiment of the headlamp of this invention.
Figure 31:
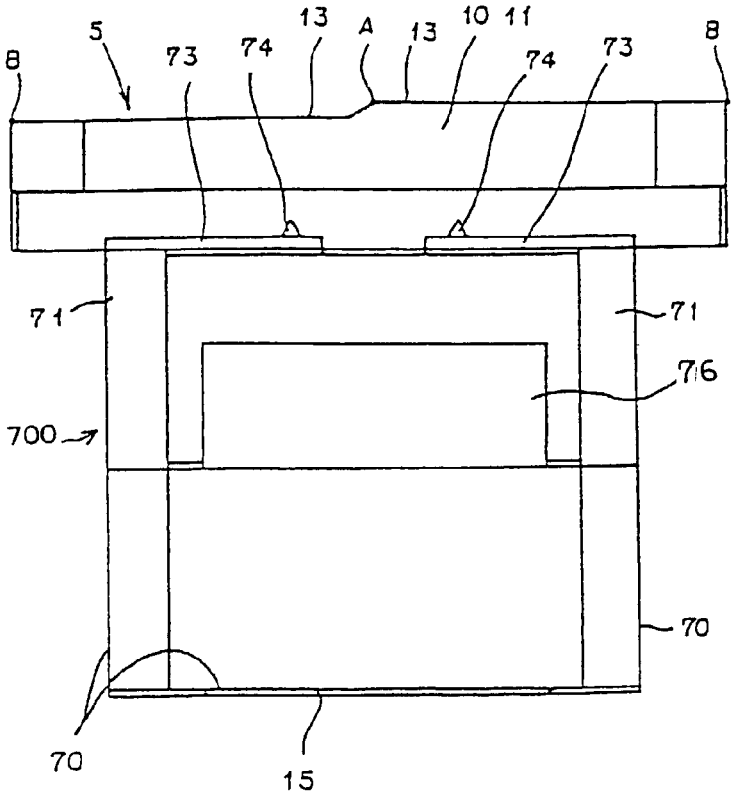
FIG. 31 is a view in the direction of arrow XXXI in FIG. 30.

When charging of the solenoid 6 with electricity is cut off, the plunger 14 advances in the direction of the arrow of a solid line, and the shade 5 is switched from the high-beam position to the low-beam position (see FIG. 29). At this time, since the upper end of the stopper piece 30 abuts against the stopper section 36, the stopper piece 30 moves in the direction of an arrow of a broken line in FIG. 29, due to the inclination of the stopper section 36, and finally the stopper piece 30 is in the state as shown in FIG. 25 and FIG. 26.

As described above, by the second embodiment, there can be achieved the same effects as those of the first embodiment.

FIG. 30 to FIG. 36 show a third embodiment of the headlamp according to this invention. In these figures, the same reference symbols as in FIG. 1 to FIG. 29 denote the same parts, respectively.

Figure 32:
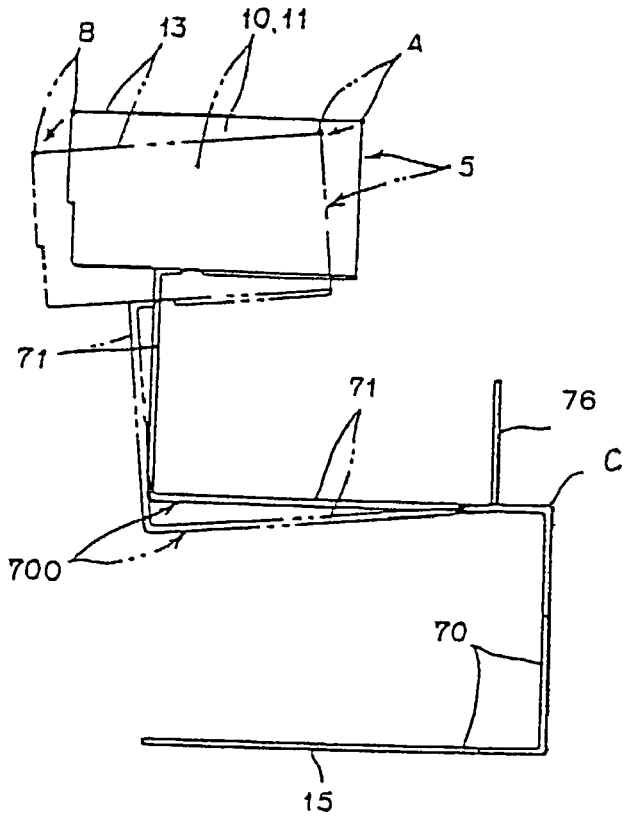
FIG. 32 is a view in the direction of arrow XXXII in FIG. 30.
Figure 33:
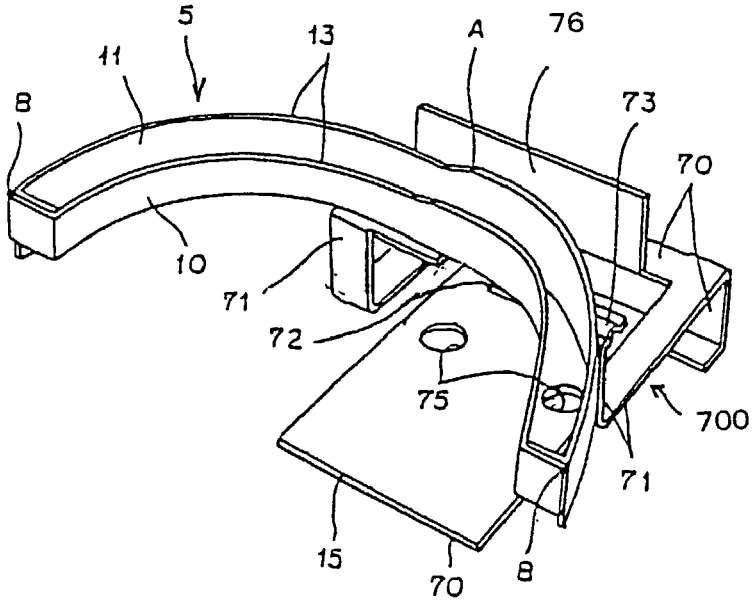
FIG. 33 is a perspective view which shows the shade and the plate spring.

The third embodiment relates to a modification example of a plate spring 700. In other words, the plate spring 700 is a plate spring having a cantilever structure, and as shown in FIG. 32, it is to switch the shade 5 making a curve, centering on a cantilever fulcrum C.

The plate spring 700 comprises a thin plate structure having resilience such as SUS (spring steel sheet), as in the plate spring 7 in the first and second embodiments. As shown in FIG. 32, the plate spring 700 is composed of a fixed portion 70 (the portion shown by a solid line) and a movable portion 71 (the portion shown by a solid line or a two-dot chain line), which form an integral structure. The boundary between the fixed portion 70 and the movable portion 71 becomes the cantilever fulcrum C. The upper central portion of the movable portion 71 of the plate spring 700 and the central portion at the lower edge of the movable portion 11 on the rear side of the shade 5 are coupled integrally. In other words, the shade 5 having a thin plate structure and the plate spring 70 having a thin plate structure are formed integrally by press working or the like. As a result, the plate spring 700 is directly fitted to the shade 5. A stiffening rib 74 is provided on the boundary between the plate spring 700 and the shade 5.

The plate spring 700 is for holding the movable portions 10 and 11 of the shade 5 in the low-beam position at the time of normal operation, for bending at the time of charging the solenoid with electricity, and for elastically returning to move the movable portions 10 and 11 of the shade 5 making a curve at the time of cutting off the charging of the solenoid with electricity, to thereby switch the shade 5 from the high-beam position to the low-beam position and hold the shade in that position.

The mounting portion 15 is integrally provided at the central portion on the lower side of the fixed portion 70 of the plate spring 700. The mounting portion 15 is provided with a through hole 75 of a small circular shape, through which a screw passes. The mounting portion 15 is fitted to the holder by a screw. The solenoid is fitted to the mounting portion 15 by the screw.

A thermal insulation board 76 is provided between the fixed portion 70 and the movable portion 71 of the plate spring 700. A long groove 72 and a semicircular small convex bar 73 for reinforcement are provided in the movable portion 71 of the plate spring 700. The plunger of the solenoid engages with the edge of the long groove 72. When the movable portions 10 and 11 of the shade 5 are moved making a curve due to advancing and retreating of the plunger, the plunger and the movable portion 71 are relatively displaced. This long groove 72 is for absorbing the relative displacement of the plunger and the movable portion 71.

Figure 34A:
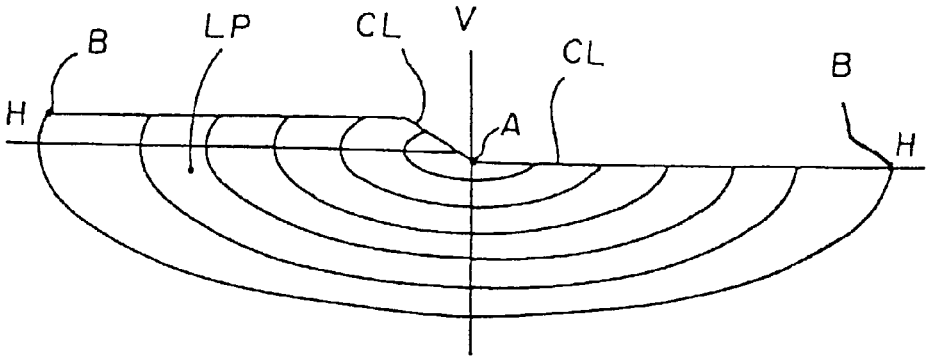
FIG. 34A is a diagram which shows the light distribution pattern for passing by, and FIG. 34B is a diagram which shows the light distribution pattern for driving.

The action by the third embodiment will be explained below. It is assumed that the shade 5 is in the low-beam position. At this time, as shown in FIG. 34A, the predetermined light distribution pattern LP for passing by can be obtained. The solenoid is then charged with electricity. The plunger of the solenoid retreats against the spring force of the plate spring 700. Accompanying this, the movable portions 10 and 11 of the shade 5 are moved making a curve, and the shade 5 is switched from the low-beam position shown by a solid line in FIG. 32 to the high-beam position shown by a two-dot chain line in FIG. 32. Therefore, as shown in FIG. 34B, the predetermined light distribution pattern HP1 for driving can be obtained.

In this third embodiment, since the movable portions 10 and 11 of the shade 5 are moved making a curve, a depressed size of point B at the opposite right and left ends of the shade 5 in the vertical direction is larger than a depressed size of point A at the center of the shade 5 in the vertical direction.

Figure 34B:
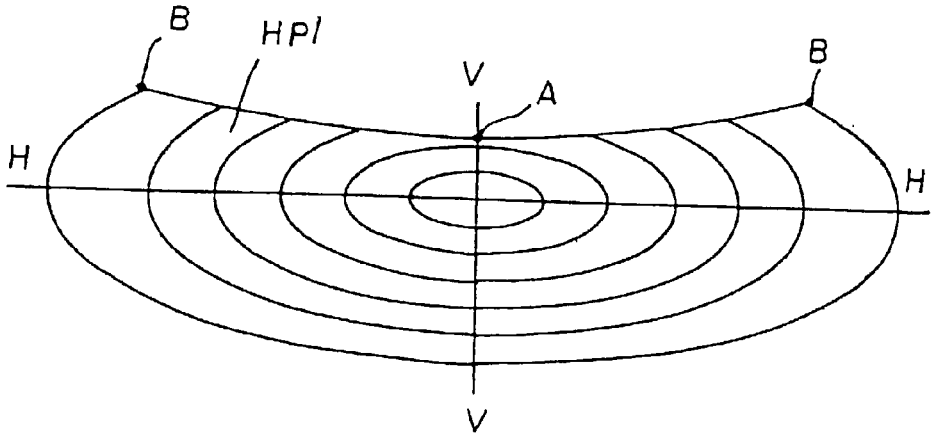

Therefore, in this third embodiment, as shown in FIG. 34B, a light distribution pattern HP1 for driving is obtained, in which the opposite right and left end portions come upwards. With this light distribution pattern HP1 for driving in which the opposite right and left end portions come upwards, traffic signs arranged on the right and left sides of the driving lane and pedestrians can be checked well visually, and hence it is most suitable for driving in the urban area. Further, since the opposite right and left end portions coming upwards of the light distribution pattern HP1 for driving are reflected by buildings on the right and left sides of the driving lane, a clear switching feeling can be obtained, at the time of switching between the light distribution pattern LP for passing by and the light distribution pattern HP1 for driving.

Electricity to the solenoid is then cut off. The plate spring 700 in the bent state as shown by a two-dot chain line in FIG. 32 is elastically returned to the state as shown by a solid line in the figure. As a result, the plunger of the solenoid advances. The movable portions 10 and 11 of the shade 5 move, making a curve, together with the advancement of the solenoid, and the position of the shade 5 is switched from the high-beam position shown by the two-dot chain line in FIG. 32 to the low-beam position shown by the solid line in FIG. 32. As a result, as shown in FIG. 34A, the predetermined light distribution pattern LP for passing by can be obtained.

As described above, in the third embodiment, the shade 5 is supported by the plate spring 700 having the cantilever structure. Therefore, in the third embodiment, the shade 5 moves, making a curve, between the low-beam position and the high-beam position. Thereby, even if the shift of the shade 5 is small, the amount of switching between the low beam and the high beam can be made large. That is, the operating amount of the solenoid can be made small, compared to the switching amount between the low beam and the high beam. Accordingly, in the third embodiment, a small solenoid can be used, and the production cost can be reduced thereby.

Figure 35A:
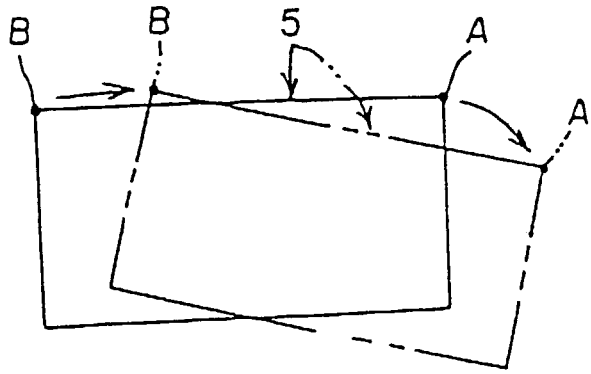
FIG. 35A is a diagram which shows a modification example of the third embodiment.

FIG. 35 shows a modification example of the third embodiment. This modification example is different from the third embodiment in the curved shift of the shade 5 from the low-beam position to the high-beam position. In other words, in the third embodiment, the shade 5 is moved forward, making a curve, and the depressed size of point B at the opposite right and left ends of the shade 5 in the vertical direction is made larger than a depressed size of point A at the center of the shade 5 in the vertical direction. On the other hand, in this modification example, as shown in FIG. 35A, the shade 5 is moved rearward, making a curve, and the shade 5 is switched from the low-beam position shown by a solid line to the high-beam position shown by a two-dot chain line, thereby the point A at the center of the shade 5 is depressed, and the point B at the opposite right and left ends of the shade 5 slightly comes up.

Figure 35B:
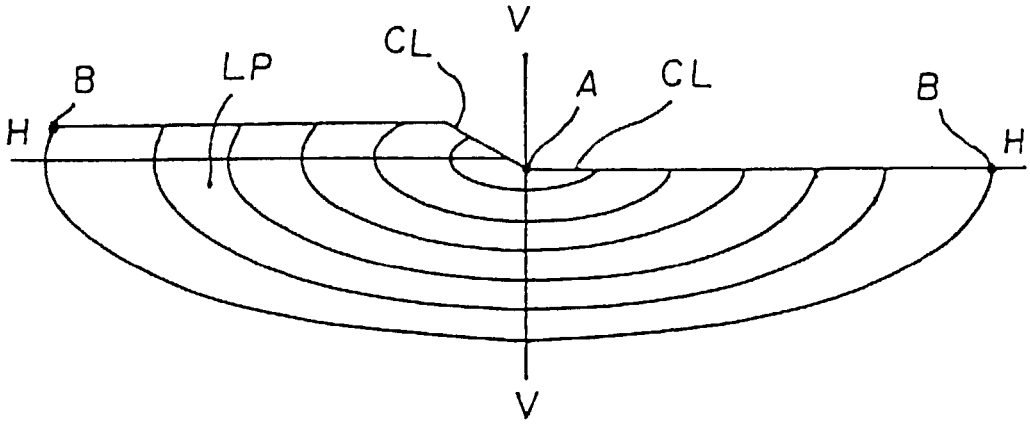
FIG. 35B is a diagram which shows the light distribution pattern for passing by, and FIG. 35C is a diagram which shows the light distribution pattern for driving.
Figure 35C:
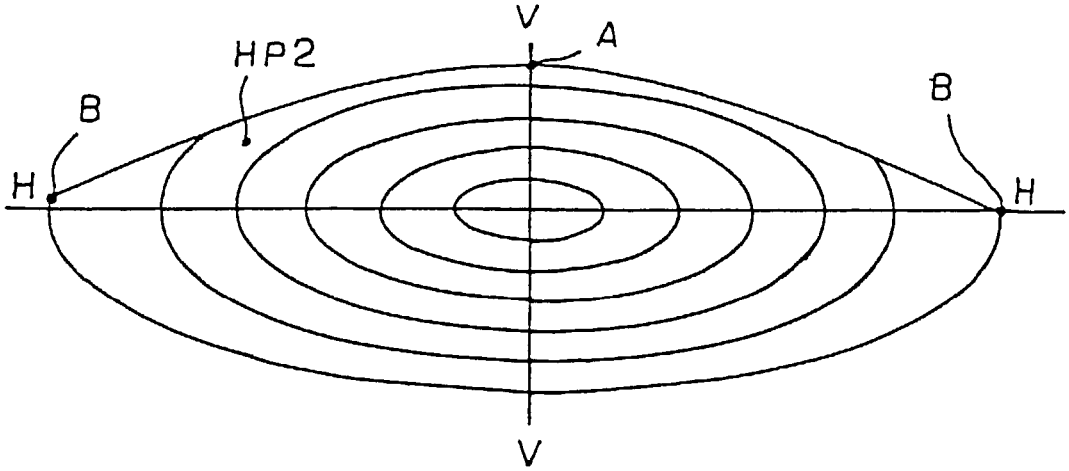

As a result, in this modification example, as shown in FIG. 35C, a light distribution pattern HP2 for driving can be obtained, in which the central portion goes upwards. With this light distribution pattern HP2 for driving in which the central portion goes upwards, the center of the driving lane can be seen well visually, and hence it is most suitable for high-speed driving. As shown in FIG. 35A, when the shade 5 is in the low-beam position shown by the solid line, as shown in FIG. 35B, a predetermined light distribution pattern LP for passing by can be obtained. This modification example can achieve the same effect as that of the third embodiment.

Figure 36:
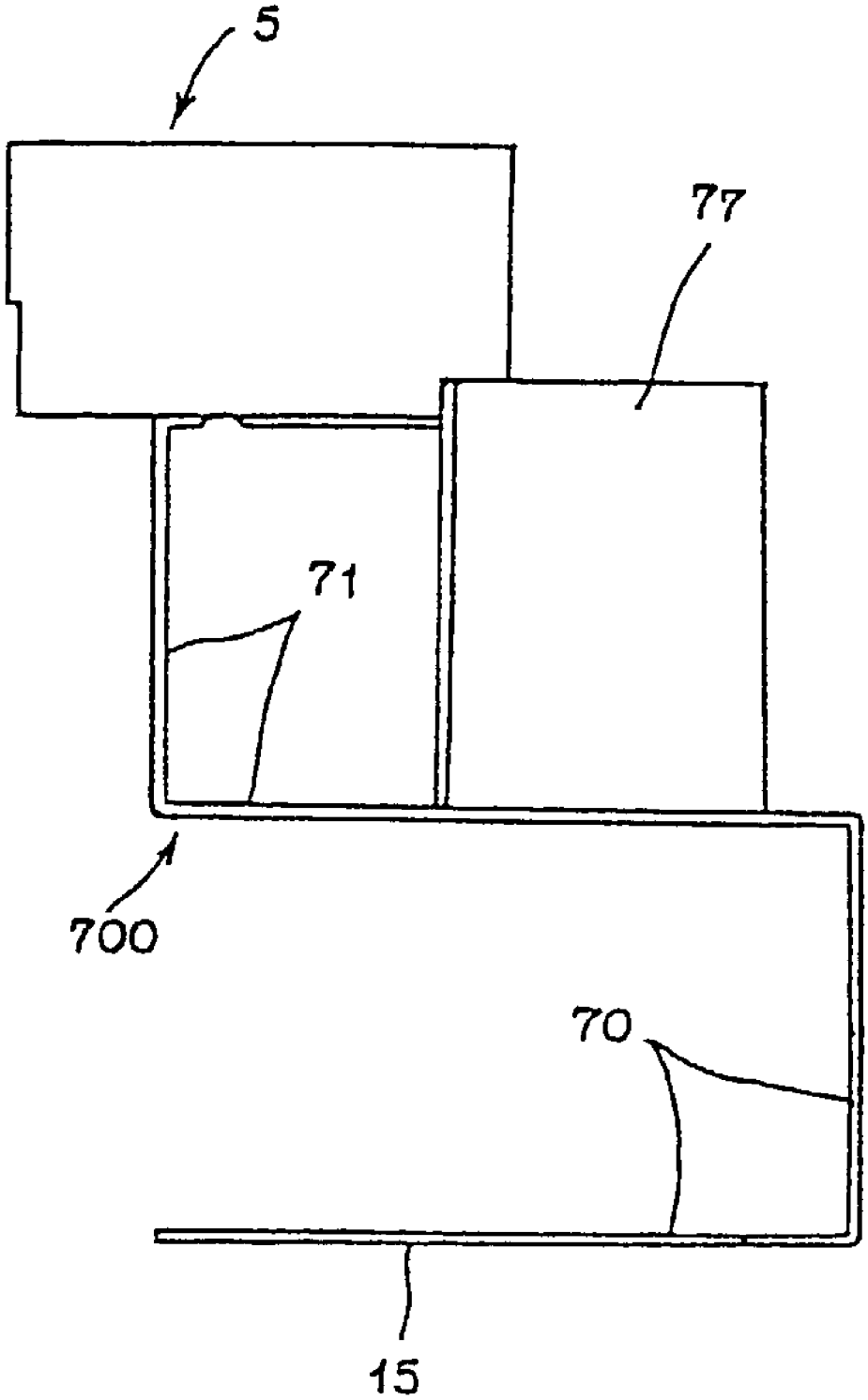
FIG. 36 is a side view of a shade and a plate spring in another modification example of the third embodiment.

FIG. 36 shows another modification example of the third embodiment. In this other modification example, a weight member (also with a thermal insulation function) 77 is provided separately from the shade 5, in the plate spring 700. In other words, in this other modification example, there are two resonance points of the plate spring 700 of the cantilever structure, that is, the shade 5 and the weight member 77.

As a result, in this other modification example, in the plate spring 700 of the cantilever structure, there is a resonance point respectively in the shade 5 (which functions as a spring) and the weight member 77 (which functions as a damper), the vibrations of the shade 5 and the vibrations of the weight member 77 counteract to each other, and hence the plate spring 700 of the cantilever structure becomes a vibration-resistant structure. Hence, in this other modification example, the spring member 700 of the cantilever structure becomes a vibration-resistant structure, and when the shade 5 is switched to either of the low-beam position and the high-beam position, the vibrations of the shade 5 become small, and the vibrations thereof stop within a short period of time, thereby the shade 5 can be stopped and located at a predetermined position reliably and within a short period of time. As a result, accurate switching between the low beam and the high beam becomes possible. By this other modification example, there can be achieved the same effects as those of the third embodiment and the modification example described above.

Examples other than the first, second and third embodiments will be explained below.

In the above-described embodiments, the shade 5 has a thin plate structure, but in this invention, the shade may have a structure other than the thin plate structure.

In the above-described embodiments, the solenoid 6 serves to switch the shade 5 to the high-beam position, and the plate spring 7 serves to switch the shade 5 to the low-beam position. However, in this invention, the configuration may be quite opposite. That is, the solenoid 6 may serve to switch the shade 5 to the low-beam position, and the plate spring 7 may serve to switch the shade 5 to the high-beam position.

In the above-described embodiments, the edge portion 13 has a structure of two thin plates, but in this invention, the edge portion may have a structure of one thin plate.

In the above-described embodiments, the movable portions 10 and 11 have a curved shape as seen from the above, such that the central portion protrudes towards the discharge lamp 2 side. But in this invention, the shape of the movable portions maybe flat, as seen from the above. Alternatively, the shape of the movable portions may be a shape bent in a trapezoid, as seen from the above, such that the central portion protrudes towards the discharge lamp side.

In the above-described embodiments, the discharge lamp 2 is used as a light source, but in this invention, a halogen lamp or the like may be used other than the discharge lamp 2.

In the above-described embodiments, a plate spring having a dome-shaped structure is used as the plate spring 7, but in this invention, spring members such as a coil spring and a plate spring may be used, other than the dome-shaped structure.

In the above-described embodiments, the thin plate 25 and the plate spring 7 form an integral structure. In this invention, however, the thin plate and the plate spring may be fixed to each other, as a separate structure.

In the above-described embodiments, the first restriction unit, the second restriction unit and the third restriction unit are respectively equipped, which restrict the low-beam position of the shade 5 in three directions substantially orthogonal to each other. In this invention, however, the first restriction unit, the second restriction unit and the third restriction unit may not be equipped.

The shape and the structure of the shade 5 and the plate spring 7 in the above-described embodiments are not particularly limited. For example, the side of the shade 5 and the plate spring 7 may be fitted to the plunger 14 side of the solenoid 6, using an E ring, but without using the mounting structure between the side of the shade 5 and the plate spring 7 and the plunger 14 side of the solenoid 6 according to the first and second embodiments.

The priority applications, Japanese Patent Application No. 2001-244666, filed Aug. 10, 2001, Japanese Patent Application No. 2001-280331, filed Sep. 14, 2001, Japanese Patent Application No. 2002-176013, filed Jun. 17, 2002, and Japanese Patent Application No. 2002-176014, filed Jun. 17, 2002, are incorporated by reference herein in their entirety.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A two-light headlamp in which a predetermined light distribution pattern for passing by and a predetermined light distribution pattern for driving are obtained from one light source, the two-light headlamp comprising:

a shade which comprises a thin plate structure, and switches the light from a light source to a low beam by which the predetermined light distribution pattern for passing by is obtained, or to a high beam by which the predetermined light distribution pattern for driving is obtained;

a plate spring which moves the shade linearly in a direction perpendicular to a light axis of the light source and switches the shade to a low-beam position, where the low beam is obtained, by a spring force and holds the shade in that position; and a solenoid which switches the shade to a high-beam position, where the high beam is obtained, by a driving force when the electric supply is ON and holds the shade in that position, wherein the solenoid has a plunger driven in the direction perpendicular to the light axis of the light source.

2. The headlamp according to claim 1, wherein the solenoid has a plunger that can advance and retreat, the solenoid is arranged below the shade, the plunger is directly fitted to the shade, and when the electric supply is ON, the plunger retreats against the spring force of the plate spring by a driving force, to thereby switch the shade from the low-beam position to the high-beam position linearly, and holds the shade in that position; and the plate spring is directly fitted to the shade, and at the time of cutting electricity to the solenoid, switches the shade from the high-beam position to the low-beam position linearly by the spring force, and holds the shade in that position.

3. The headlamp according to claim 1, wherein the plate spring forms an integral structure with the shade having a thin plate structure.

4. The headlamp according to claim 1, wherein the plate spring forms a dome-shaped structure.

5. The headlamp according to claim 1, wherein the shade comprises a movable portion which switches the shade to either the low beam or the high beam, and a fixed portion, and the size of the movable portion is substantially the same as that of a stroke of the movable portion moved by switching by the solenoid and the plate spring, and the shade is connected to the plunger and the plate spring such that the shade is driven linearly in the direction perpendicular to the light axis.

6. The headlamp according to claim 1, wherein a part of the shade which switches either to the low beam or to the high beam has a curved shape when seen from above, such that the central portion protrudes towards the light source, and an edge portion of the shade which forms a cut line of the light distribution pattern for passing by is composed of two thin plates.

7. A two-light headlamp in which a predetermined light distribution pattern for passing by and a predetermined light distribution pattern for driving are obtained based on one light source, the two-light headlamp comprising:

a shade which comprises a thin plate structure, and switches the light from a light source to a low beam by which the predetermined light distribution pattern for passing by is obtained, or to a high beam by which the predetermined light distribution pattern for driving is obtained;

a plate spring which moves the shade linearly in a direction perpendicular to a light axis of the light source and supports the shade in a cantilever method and switches the shade to a low-beam position, where the low beam is obtained, by a spring force and holds the shade in that position; and a solenoid which switches the shade to a high-beam position, where the high beam is obtained, by a driving force when the electric supply is ON and holds the shade in that position, wherein the solenoid has a plunger driven in the direction perpendicular to the light axis of the light source.

8. The headlamp according to claim 7, wherein the solenoid has a plunger that can advance and retreat, the solenoid is arranged below the shade, the plunger is directly fitted to the shade, and when the electric supply is ON the plunger retreats against the spring force of the plate spring by a driving force, to thereby switch the shade from the low-beam position to the high-beam position, making a curve about a fulcrum of the plate spring, and holds the shade in that position; and the plate spring is directly fitted to the shade, and when the electric supply to the solenoid is stopped, switches the shade from the high-beam position to the low-beam position by the spring force, making a curve about a fulcrum of the plate spring, and holds the shade in that position.

9. The headlamp according to claim 7, wherein the plate spring forms an integral structure with the shade having a thin plate structure.

10. The headlamp according to claim 7, wherein the plate spring is provided with a weight member apart from the shade, and hence there are two resonance points of the plate spring.

11. The headlamp according to claim 7, wherein the shade is divided into a movable portion which switches the shade to either the low beam or the high beam, and a fixed portion, being the other parts, and the size of the movable portion is substantially the same size as that of a stroke of the movable portion moved by switching by the solenoid and the plate spring.

12. The headlamp according to claim 7, wherein a part of the shade which switches either to the low beam or to the high beam has a curved shape, as seen from the above, such that the central portion protrudes towards the light source, and an edge portion of the shade which forms a cut line of the light distribution pattern for passing by is composed of two thin plates.

13. A two-light headlamp in which a predetermined light distribution pattern for passing by and a predetermined light distribution pattern for driving are obtained by switching from one light source, which comprises:

a shade which switches the light from the light source to a low beam by which the predetermined light distribution pattern for passing by is obtained, or to a high beam by which the predetermined light distribution pattern for driving is obtained; and a solenoid and a plate spring which switch the shade to a low-beam position where the low beam is obtained or to a high-beam position where the high beam is obtained, wherein the solenoid has a plunger that can advance and retreat, a mounting portion is provided at the tip of the plunger via a neck portion narrowed in the middle, and a thin plate is provided in the shade and the plate spring side, and a first hole, a second hole and a latch are respectively provided in the thin plate, the first hole is a hole in which the neck portion is located to thereby engage a peripheral edge of the first hole with the mounting portion, the second hole is a hole into which the mounting portion and the neck portion are inserted, so that the neck portion is located from the second hole to the first hole, and the latch is provided between the edge of the first hole and the edge of the second hole, crosswise with respect to the moving direction of the neck portion from the second hole to the first hole, for restricting that the neck portion located in the first hole moves from the first hole to the second hole, to thereby prevent the engagement state of the peripheral edge of the first hole with the mounting portion from coming off.

14. The headlamp according to claim 13, wherein the thin plate is formed in a flat plate shape substantially orthogonal to the switching direction of the shade, and a third hole is provided between the first hole and the second hole, facing the latch, which guides the neck portion from the second hole to bypass the latch and be located in the first hole.

15. The headlamp according to claim 14, wherein a stopper section which restricts the movement of the shade when the electric supply to the solenoid is stopped is provided, and the stopper section restricts relatively movement of the neck portion and the thin plate in the direction in which the latch is provided.

16. The headlamp according to claim 13, wherein the thin plate comprises a first thin plate bent towards substantially the same direction as the switching direction of the shade, and a second thin plate bent towards the direction substantially orthogonal to the switching direction of the shade, and the first hole is provided in the second thin plate, the second hole is provided in the first thin plate, and the latch is provided in the first thin plate.

17. The headlamp according to claim 16, wherein a stopper section which restricts the movement of the shade the electric supply to the solenoid is stopped is provided, and the stopper section restricts relative movement of the neck portion and the thin plate in the direction in which the first hole and the second hole are connected.

18. A two-light headlamp in which a predetermined light distribution pattern for passing by and a predetermined light distribution pattern for driving are obtained based on one light source, the two-light headlamp comprising:

a shade which switches the light from the light source to a low beam by which the predetermined light distribution pattern for passing by is obtained, or to a high beam by which the predetermined light distribution pattern for driving is obtained;

a solenoid and a plate spring, which move the shade linearly in a direction perpendicular to a light axis of the light source and switch the shade to a low-beam position where the low beam is obtained or to a high-beam position where the high beam is obtained; and a restriction unit which restricts the low-beam position of the shade in three directions which are substantially orthogonal to each other, wherein the restriction unit comprises a first restriction unit which restricts the switching direction of the shade, a second restriction unit which restricts the direction substantially orthogonal to the restriction direction of the first restriction unit, and a third restriction unit which restricts the direction substantially orthogonal to the restriction direction of the first restriction unit and the restriction direction of the second restriction unit.

19. The headlamp according to claim 18, wherein the first restriction unit comprises the shade, a movable side of the plate spring and a fixed side with respect to the movable side, and when the shade is switched from the high-beam position to the low-beam position, the movable side abuts against the fixed side, to restrict the low-beam position of the shade in the switching direction of the shade, the second restriction unit comprises the fixed side and two clamping pieces provided on the movable side, and when the shade is switched from the high-beam position to the low-beam position, the two clamping pieces clamp the fixed side therebetween, to thereby restrict the low-beam position of the shade in the direction substantially orthogonal to the restriction direction of the first restriction unit, and the third restriction unit comprises wall faces at the opposite ends of a long notch provided on the fixed side and opposite end faces of either one of the two clamping pieces, and when the shade is switched from the high-beam position to the low-beam position, at least one of the two clamping pieces is inserted into the long notch, and the low-beam position of the shade is restricted in the direction substantially orthogonal to the restriction direction of the first restriction unit and the restriction direction of the second restriction unit, by the wall faces at the opposite ends of the long notch and the opposite end faces of either one of the two clamping pieces.

20. A two-light headlamp in which a predetermined light distribution pattern for passing by and a predetermined light distribution pattern for driving are obtained from one light source, the two-light headlamp comprising:

a shade which comprises a thin plate structure, and switches the light from the light source to a low beam by which the predetermined light distribution pattern for passing by is obtained, or to a high beam by which the predetermined light distribution pattern for driving is obtained;

a plate spring which forms an integral structure with the shade, and switches the shade to a low-beam position, where the low beam is obtained, by a spring force and holds the shade in that position; and a solenoid which switches the shade to a high-beam position, where the high beam is obtained, by a driving force when the electric supply is ON and holds the shade in that position, wherein the solenoid has a plunger that advances and retreats, a mounting portion is provided at the tip of the plunger via a neck portion narrowed in the middle, a thin plate is provided in the shade and the plate spring side, and a first hole, a second hole and a latch are respectively provided in the thin plate, the first hole is a hole in which the neck portion is located to thereby engage a peripheral edge of the first hole with the mounting portion, the second hole is a hole into which the mounting portion and the neck portion are inserted, so that the neck portion is located from the second hole to the first hole, and the latch is provided between the edge of the first hole and the edge of the second hole, crosswise with respect to the direction connecting the first hole and the second hole, for restricting that the neck portion located in the first hole moves from the first hole to the second hole, to thereby prevent the engagement state of the peripheral edge of the first hole with the mounting portion from coming off.

21. The headlamp according to claim 20, comprising a restriction unit which restricts the low-beam position of the shade in three directions which are substantially orthogonal to each other, wherein the restriction unit comprises a first restriction unit which restricts the switching direction of the shade, a second restriction unit which restricts the direction substantially orthogonal to the restriction direction of the first restriction unit, and a third restriction unit which restricts the direction substantially orthogonal to the restriction direction of the first restriction unit and the restriction direction of the second restriction unit.

22. A two-light headlamp in which a predetermined light distribution pattern for passing by and a predetermined light distribution pattern for driving are obtained from one light source, the two-light headlamp comprising:

a shade which comprises a thin plate structure, and switches the light from a light source to a low beam by which the predetermined light distribution pattern for passing by is obtained, or to a high beam by which the predetermined light distribution pattern for driving is obtained;

a plate spring which moves the shade linearly in a direction perpendicular to a light axis of the light source and switches the shade to a low-beam position, where the low beam is obtained, by a spring force and holds the shade in that position; and a solenoid which switches the shade to a high-beam position, where the high beam is obtained, by a driving force when the electric supply is ON and holds the shade in that position, wherein the thin plate structure is configured to partially block light from the light source when switched in either the low beam or high beam position.

23. A two-light headlamp in which a predetermined light distribution pattern for passing by and a predetermined light distribution pattern for driving are obtained based on one light source, the two-light headlamp comprising:

a shade which comprises a thin plate structure, and switches the light from a light source to a low beam by which the predetermined light distribution pattern for passing by is obtained, or to a high beam by which the predetermined light distribution pattern for driving is obtained;

a plate spring which moves the shade linearly in a direction perpendicular to a light axis of the light source, supports the shade in a cantilever methods, and switches the shade to a low-beam position, where the low beam is obtained, by a spring force and holds the shade in that position; and a solenoid which switches the shade to a high-beam position, where the high beam is obtained, by a driving force when the electric supply is ON and holds the shade in that position, wherein the thin plate structure is configured to partially block light from the light source when switched in either the low beam or high beam position.

* * * * *